US011884472B2

(12) United States Patent
Lee

(10) Patent No.: US 11,884,472 B2
(45) Date of Patent: Jan. 30, 2024

(54) MIXING CONTAINER COMBINED WITH DRINKING CONTAINER

(71) Applicant: Sangrok Lee, Seoul (KR)

(72) Inventor: Sangrok Lee, Seoul (KR)

( * ) Notice: Subject to any disclaimer, the term of this patent is extended or adjusted under 35 U.S.C. 154(b) by 0 days.

(21) Appl. No.: 17/526,779

(22) Filed: Nov. 15, 2021

(65) Prior Publication Data

US 2022/0153500 A1 May 19, 2022

(30) Foreign Application Priority Data

Nov. 17, 2020 (KR) ..... 10-2020-0154070

(51) Int. Cl.
*B65D 81/32* (2006.01)
*A47G 19/12* (2006.01)

(52) U.S. Cl.
CPC ..... *B65D 81/3211* (2013.01); *A47G 19/12* (2013.01); *A47G 2019/122* (2013.01)

(58) Field of Classification Search
CPC ..... B65D 81/3211; B65D 81/3205; B65D 81/32; B65D 51/2835; B65D 51/2828; B65D 51/2814; B65D 51/2807
USPC ..... 206/222, 219
See application file for complete search history.

(56) References Cited

U.S. PATENT DOCUMENTS 4,982,875 A * 1/1991 Pozzi ..... B65D 81/3222 604/416
5,000,314 A * 3/1991 Fuller ..... B65D 81/3205 215/DIG. 8
6,527,110 B2 * 3/2003 Moscovitz ..... B67B 7/26 215/DIG. 8
7,308,915 B2 * 12/2007 Johns ..... B65D 81/3211 141/100
8,151,985 B2 * 4/2012 Owoc ..... B65D 51/002 206/219
10,562,691 B2 * 2/2020 Krammer ..... B65B 3/04
2008/0314775 A1 12/2008 Owoc ..... 206/222
(Continued)

FOREIGN PATENT DOCUMENTS

CN 1914097 A 2/2007
DE 202009007124 A1 10/2009
(Continued)

OTHER PUBLICATIONS

European Search Report dated Apr. 5, 2022, issued to European Application No. 21208783.7.
(Continued)

*Primary Examiner* — Steven A. Reynolds
(74) *Attorney, Agent, or Firm* — Stein IP, LLC

(57) ABSTRACT

A concentrate container that is coupled to a drinking container having an output for discharging a drink is proposed. The concentrate container has a chamber in which a concentrate is kept, an outlet through which a concentrate is put into the drinking container, and a container mouth for discharging a liquid mixture of the concentrate and a drink to the outside when the drinking container and the concentrate container are combined. The inner diameter of the concentrate container outlet is determined to be fitted on the drinking container outlet, a thread is formed inside the concentrate container outlet, and the thread is engaged with a thread of the drinking container outlet.

4 Claims, 32 Drawing Sheets

(56) References Cited

U.S. PATENT DOCUMENTS

| | | | | |
|---|---|---|---|---|
| 2013/0075287 | A1* | 3/2013 | Sharon | B65D 81/3222 206/219 |
| 2014/0001064 | A1 | 1/2014 | Aloia | 206/221 |
| 2021/0122542 | A1* | 4/2021 | Jo (Zee) | B65D 83/0094 |

FOREIGN PATENT DOCUMENTS

| | | | |
|---|---|---|---|
| FR | 2569666 | A1 | 3/1986 |
| JP | 3133066 | U | 6/2007 |
| KR | 10-2005-0099394 | A | 10/2005 |
| KR | 10-0900728 | B1 | 6/2009 |
| KR | 10-2014-0022330 | A | 2/2014 |
| KR | 20-0473241 | Y1 | 6/2014 |
| KR | 20-0488046 | Y1 | 12/2018 |
| WO | WO 2018/077363 | A1 | 5/2018 |

OTHER PUBLICATIONS

Korean Office Action dated Jul. 18, 2023, issued to related Korean Application No. 10-2021-0143279.
Notice of grant of registration of European family patents dated Jun. 28, 2023, issued to European Application No. 21208783.7.

* cited by examiner (A)

(B)

MIXING CONTAINER COMBINED WITH DRINKING CONTAINER

CROSS REFERENCE TO RELATED APPLICATION

The present application claims priority to Korean Patent Application No. 10-2020-0154070, filed Nov. 17, 2020, the entire contents of which is incorporated herein for all purposes by this reference.

BACKGROUND OF THE INVENTION

Field of the Invention

The present disclosure relates to a concentrate container that is coupled to a drinking container and, more particularly, to a concentrate container that keeps an additive and is coupled to a drinking container keeping a drink so that a user can simply mix and drink the additive and the drink.

Description of the Related Art

Maesil (a kind of plum) extract, omija (Schisandra berry) extract, sanyacho (Wild plant) fermentation broth, etc. that are traditionally made by mixing and fermenting Maesil, Omija, Sanyacho, etc. with sugar are drinks that people dilute with water and frequently drink as a dessert after eating food or drink as tea with cookies.

Drinks made by mixing an ion drink with an energy drink or adding fruit juice or syrup to a drink are the trend of drinks that are popular with young people.

Mixture drinks made by adding lemon, lime, Mojito, maple syrup, etc. to an oriental raisin tree drink that is good for diet and detoxification at suitable ratios are clean and light, so they are popular.

Meanwhile, materials having high Brix degree or high salinity hardly spoil even though an artificial preservative is not added or they are not sterilized at high temperature, so the can be kept for a long period of time.

However, general drinks that are on the market have very low salinity and around 15° Bx and are apt to spoil or rot quickly at room temperature, so they are sterilized at high temperature or added with a preservative to increase the retention period including the shelf life till the point in time they are sold to consumers.

In general, the products of drink on the market are manufactured through a bottling process of mixing water and additives (high-concentration extracts in optimal ratios. The mixture drinks are distributed with a large amount of water and extracts mixed, so the cost for distribution is high. Further, since additives or high-temperature sterilization is unavoidably required to increase the retention period, the nutrients are destroyed or harmful substances may be added in the high-temperature processing process.

Alternately, consumers dilute and drink high-concentration extracts, such as maple syrup, maesil ferment, persimmon vinegar, lemon juice, and honey, with water in person. It is required to separately measure the amounts of an extract and water in order to dilute a high-concentration extract with water, but there is a problem that convenience for consumers is deteriorated in this case.

Accordingly, the applicant(s) has developed a concentrate container that keeps a predetermined amount of additive such as a high-concentration extract and is coupled to a drinking container keeping a drink so that a user can simply mix and drink the additive and the drink.

DOCUMENTS OF RELATED ART (Patent Document 1) Korean Patent No. 10-0900728

SUMMARY OF THE INVENTION

The present disclosure has been made in an effort to solve the problems and an objective of the present disclosure is to provide a concentrate container that allows for long-period of storage and distribution of additives such as a high-concentration extract, reduces the cost for distribution, is simply coupled to a drinking container keeping a drink, and enables a user to mix and drink a drink mixture with the optimal taste.

A concentrate container that is coupled to a drinking container having an output for discharging a drink is provided. The concentrate container has a chamber in which a concentrate is kept, an outlet through which a concentrate is put into the drinking container, and a container mouth for discharging a liquid mixture of the concentrate and a drink to the outside when the drinking container and the concentrate container are combined. The inner diameter of the concentrate container outlet is determined to be fitted on the drinking container outlet, a thread is formed inside the concentrate container outlet, and the thread is engaged with a thread of the drinking container outlet. Accordingly, an objective of the present disclosure is achieved.

An outlet of the drinking container is inserted in the concentrate container and is moved toward a chamber of the concentrate container by thread-fastening, or a vertical movable valve is further disposed between the chamber of the concentrate container and the outlet of the concentrate container to prevent a concentrate in the chamber from moving toward the outlet.

Further, a concentrate container that is coupled to a drinking container having an output for discharging a drink is provided. The concentrate container has a chamber in which a concentrate is kept, an outlet through which a concentrate is put into the drinking container, and a container mouth for discharging a liquid mixture of the concentrate and a drink to the outside when the drinking container and the concentrate container are combined. A mouth handle and a mouth insertion portion are provided at the upper end of the concentrate container outlet. The mouth handle may be provided to be exposed at the upper end of the concentrate container outlet and the mouth insertion portion may be inserted in the concentrate container outlet or may be exposed to the outside.

When the mouth insertion portion is exposed out of the concentrate container outlet, the vertical movable valve is moved, whereby the concentrate in the chamber is discharged to the outlet, or the mouth insertion portion and the vertical movable valve are connected through a valve connection bar.

As another embodiment of the present disclosure, a concentrate container that is coupled to a drinking container having an output for discharging a drink is provided. The concentrate container has a chamber in which a concentrate is kept, an outlet through which a concentrate is put into the drinking container, and a container mouth for discharging a liquid mixture of the concentrate and a drink to the outside when the drinking container and the concentrate container are combined. A mouth handle and a mouth insertion portion are provided at the upper end of the concentrate container outlet. The mouth handle may be provided to be exposed at the upper end of the concentrate container outlet and the mouth insertion portion may be inserted in the concentrate container outlet or may be exposed to the outside.

When the mouth insertion portion is exposed out of the concentrate container outlet, the vertical movable valve is moved and the concentrate in the chamber is discharged to the outlet.

The mouth insertion portion and the vertical movable valve are connected through a connection bar, and when the mount insertion portion is exposed out of the concentrate container outlet, the vertical movable valve is moved, whereby the concentrate in the chamber is discharged to the outlet.

Another embodiment of the present disclosure includes: a mixing container having a chamber that keeps an additive to be mixed with a drink kept in a drinking container, and a discharge part for discharging the additive kept in the chamber; a connector having a passage part that is coupled to the mixing container to communicate with the discharge part, coupled to the drinking container, having an outlet for discharging the additive flowing in the passage part to the drinking container, and connecting the mixing container and the drinking container; a blocking film provided at the discharge part or the passage part and blocking the discharge part or the passage part; and a cutter provided at any one of the mixing container and the connector, and cutting the blocking film provided at the other one of the mixing container and the connector when the mixing container and the connector are moved with respect to each other such that the discharge part and the passage part communicate with each other.

The present disclosure further includes a spacer separably provided at the mixing container or the connector and maintaining a gap between the mixing container and the connector to prevent the cutter from cutting the blocking film.

The present disclosure further includes a connector cap separably provided at the mixing container or the connector, and keeping and protecting the connector therein. The mixing container further includes an assistant passage part that communicates with the chamber, and a mixing container cap separably provided at the assistant passage part and opening or closing the assistant passage part.

As another embodiment of the present disclosure, there is provided a cap chamber that is fastened to the upper end of a cup filled with a drink and has a space therein so that a concentrate or powder can be put therein. The cup chamber is composed of a cup-outer portion forming the outer portion of the chamber and a chamber bottom forming the lower portion of the chamber. The concentrate or powder is kept in the space defined by the chamber-outer portion and the chamber bottom, the chamber bottom is inclined, and an inlet is formed at the lower end of the inclined structure.

An outlet is formed at the upper portion of the cup chamber, and the inlet and the outlet are sealed by a chamber bottom cover and a chamber top cover.

An upper protrusion or a lower protrusion is further provided at the outlet or the inlet, and the upper protrusion or the lower protrusion is covered with a chamber top cap or a chamber bottom cap.

According to the present disclosure, it is easy to keep and distribute an additive such as a high-concentration extract for a long period of time and reduce the cost for distribution. Further, it is possible to conveniently mix an additive and a drink at an optimal ratio and drink the mixture with an optimal taste by simply mounting the mixing container filled with a predetermined amount of additive on the drinking container filled with the drink.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
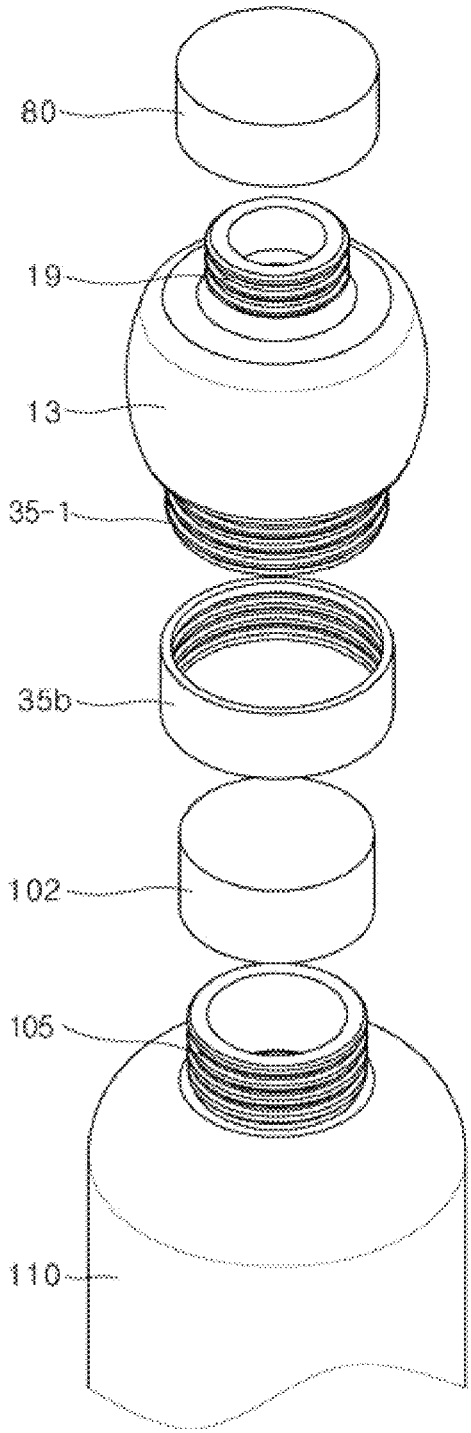
FIGS. 1 and 2 are views showing the coupled state of a drinking container and a concentrate container according to a first embodiment of the present disclosure.

The advantages and features of the present disclosure, and methods of achieving them will be clear by referring to the exemplary embodiments that will be describe hereafter in detail with reference to the accompanying drawings. However, the present disclosure is not limited to the disclosed embodiments and may be implemented in other various ways. Further, the embodiments are provided to complete the present disclosure and let those skilled in the art to completely know the scope of the present disclosure.

The terms used herein are provided to describe embodiments without limiting the present disclosure. In the specification, a singular form includes a plural form unless specifically stated in the sentences. The terms "comprise" and/or "comprising" used herein do not exclude that another component exists or is added other than the stated component. Throughout the specification, the same reference numerals indicate the same components, and the term "and/or" includes each of the stated components and all of one or more combinations. Although terms "first", "second", etc. are used to describe various components, it should be noted that these components are not limited by the terms. These terms are used only for discriminating a component from another component. Accordingly, it should be noted that a first component that is stated below may be a second component within the spirit of the present invention.

Unless defined otherwise, all terms (including technological and scientific terminologies) used herein may be used as meanings that those skilled in the art can commonly understand. Terms defined in common dictionaries are not construed ideally or excessively unless specifically clearly defined.

The present disclosure is described hereafter in detail with reference to the accompanying drawings.

It should be noted that, in the specification, a drink is a general term that means drinking water, natural water, liquors, etc., and a concentration is a general term that means a high-concentration extract, a concentrate having predetermined concentration, a powder, etc.

First Embodiment

Figure 2:
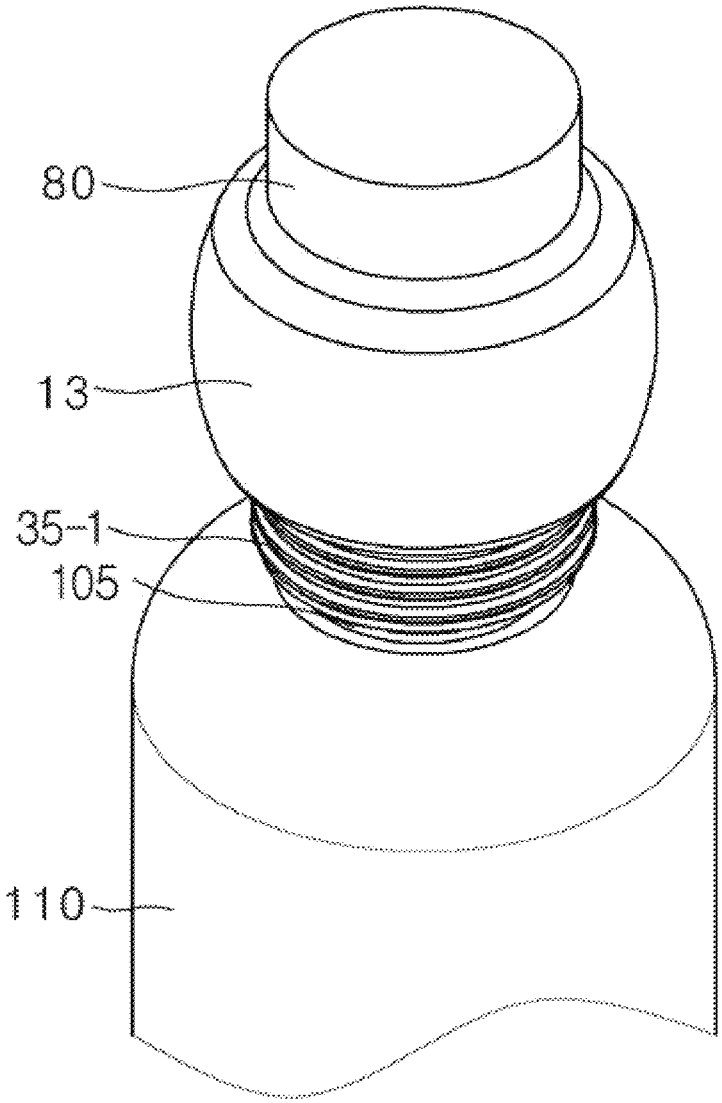

FIGS. 1 and 2 are views showing the coupled state of a drinking container and a concentrate container according to a first embodiment of the present disclosure.

FIG. 1 shows a drinking container 100 and a concentrate container. Drinkable water, natural water, liquor, or the like is in the drinking container 100, and a high-concentration extract, a concentrate having predetermined concentration, or the like is in the concentrate container.

A mixing container 10 includes: a chamber 13 in which a concentrate is kept, a container outlet 35-1 through which a concentrate is discharged down (the outlet directly connected to the mixing container 10 is referred to as the container outlet 35-1 to be discriminated from the outlet 35 connected to a connector 30); an outlet cap 35*b* that functions as a cap of the outlet to close the outlet; an assistant passage part 19 through which a drink mixture (a mixture of a drink and a concentrate) is discharged with the mixing container 10 and the drinking container 100 coupled; and a mixing container cap 80 that is a cap for closing a container mouth.

The outlet cap 35*b*, which is a cap for closing the container outlet 35-1, is discriminated from a connector cap 70 that is a cap for closing the connector 30.

A plurality of scale lines for showing the amount of an additive in the chamber 13 may be marked on the chamber 13. The scale lines may be common scale lines, but they are not shown in the present disclosure.

The drinking container 100 includes a container chamber 110 in which a drink is kept, a neck 105 through which a drink is discharged, and a drinking container cap 102 that functions as a cap for closing the neck 105.

FIG. 2 is a view showing the coupled state of the drinking container and the concentrate container. A method of separating the drinking container cap 102 from the drinking container neck 105, separating the outlet cap 35*b* from the container outlet 35-1 of the mixing container 10, and then coupling the concentrate container outlet 35-1 to the drinking container neck 105 is used.

FIGS. 3 to 6 are views showing the principle that the concentrate container and the drinking container are coupled and a concentrate flows into the drinking container.

Figure 3:
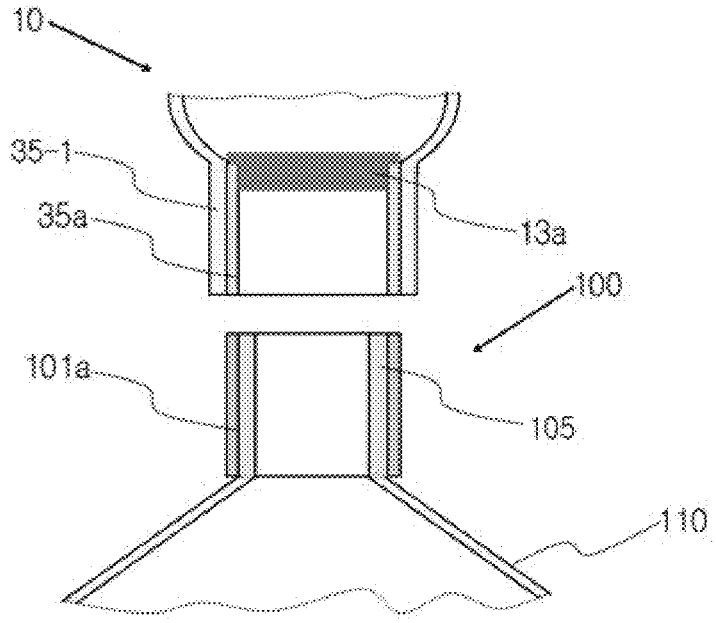
FIGS. 3 to 6 are views showing the principle that the concentrate container and the drinking container are coupled and a concentrate flows into the drinking container.

FIG. 3 is a cross-sectional view with the mixing container 10 and the drinking container 100 separated. A valve cap 13*b* that keeps a concentrate in the chamber 13 is disposed at the interface between the chamber 13 and the container outlet 35-1, and an outlet thread 35*a* that can be thread-fastened to the container outlet 35-1 is disposed in the container outlet 35-1. An outlet thread 101*a* is also thread-fastened to the drinking container neck 105.

Figure 4:
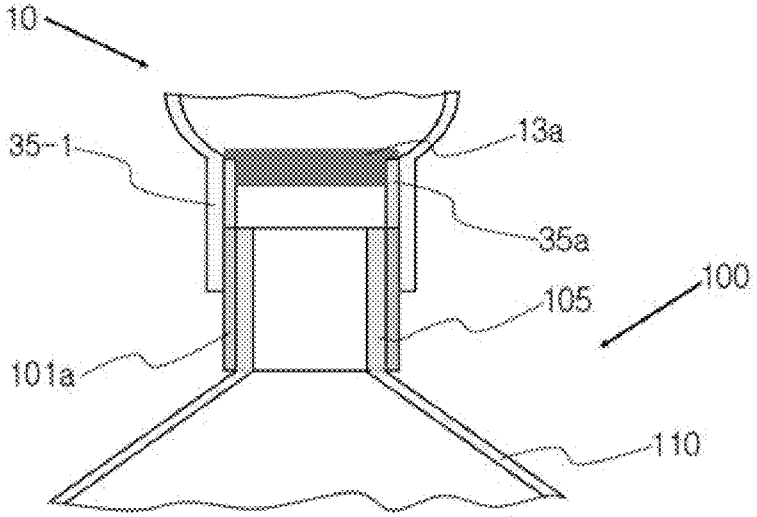

FIG. 4 is a view showing the step in which the mixing container 10 and the drinking container 100 start to be coupled. The outlet thread 35*a* of the concentrate container and the outlet thread 101*a* of the drinking container are thread-fastened to each other.

Accordingly, the size of the container outlet 35-1 of the mixing container 10 should be determined such that the container outlet 35-1 can be coupled to the drinking container neck 105, and the drinking container neck 105 should be fitted in the container outlet 35-1 of the mixing container 10.

Figure 5:
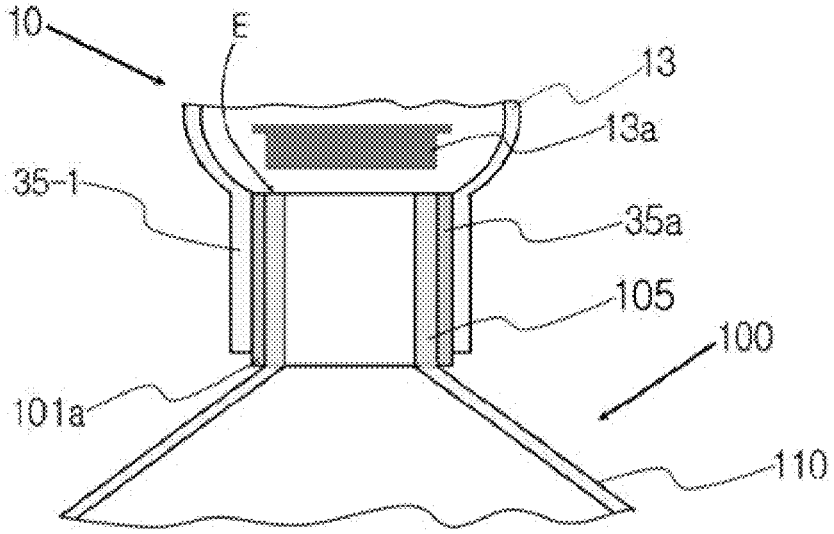

FIG. 5 is a view showing a method of separating a valve cap. As the drinking container neck 15 is fitted into the container outlet 35-1 of the mixing container 10, the end (the portion indicated by the arrow E in FIG. 5) of the drinking container neck 105 gradually pushes the valve cap 13*b*. Accordingly, the container outlet 35-1 of the chamber 13 is opened and the concentrate in the chamber 13 flows out of the container outlet 35-1 and then flows into the drinking container through the drinking container neck 105.

That is, a passage is formed between the drinking container 100 and the mixing container 10, so the contents are mixed.

Figure 6:
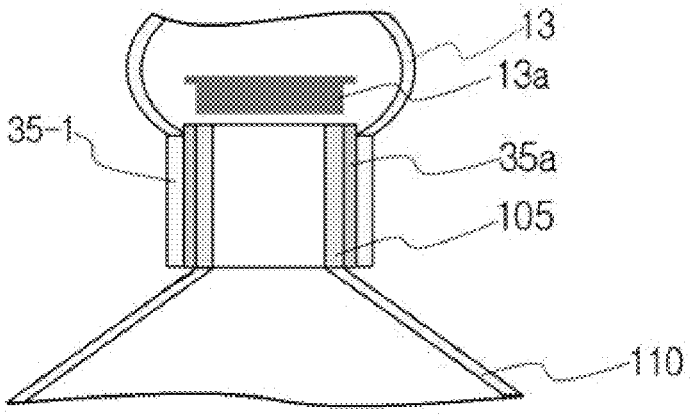

FIG. 6 is a view showing an embodiment when the drinking container neck 105 is further moved into the chamber 13 beyond the concentrate container outlet 35. That is, FIG. 6 is a view when the end (the portion indicated by the arrow E in FIG. 5) of the drinking container neck 105 is moved into the chamber 13. In this case, the movement distance may be as small as 5 mm. Substantially, even though the end of the drinking container neck 105 is moved even only 1 mm into the chamber 13, an effect that the valve cap 13*b* is opened is achieved.

Figure 7:
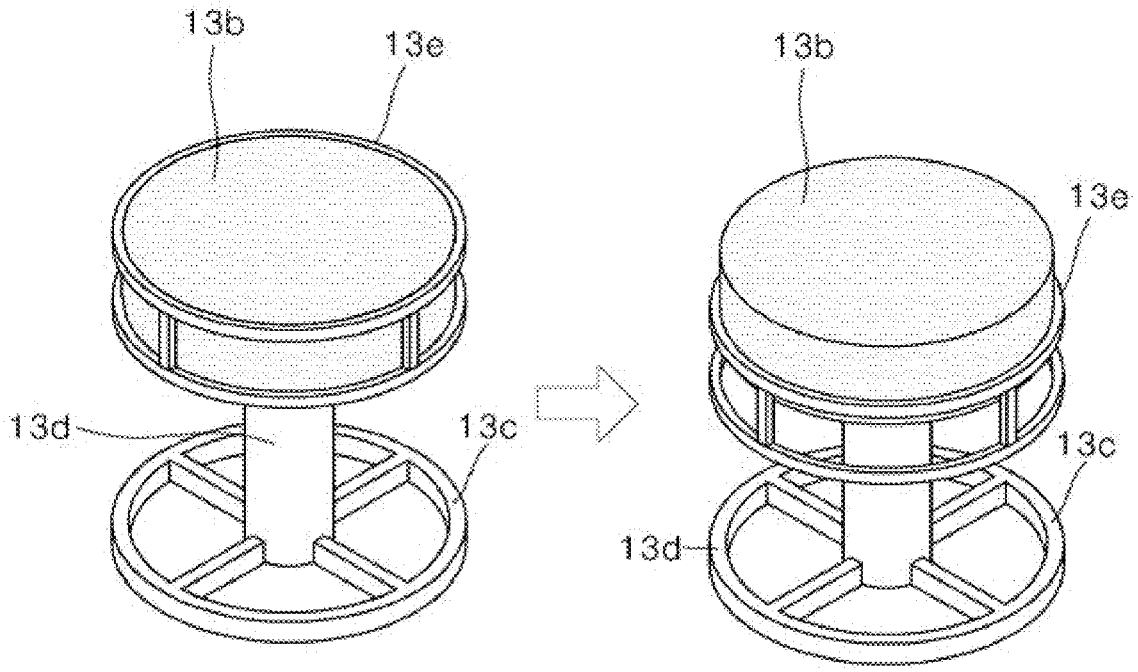
FIGS. 7 to 9 are views showing an embodiment of a valve cap.
Figure 8:
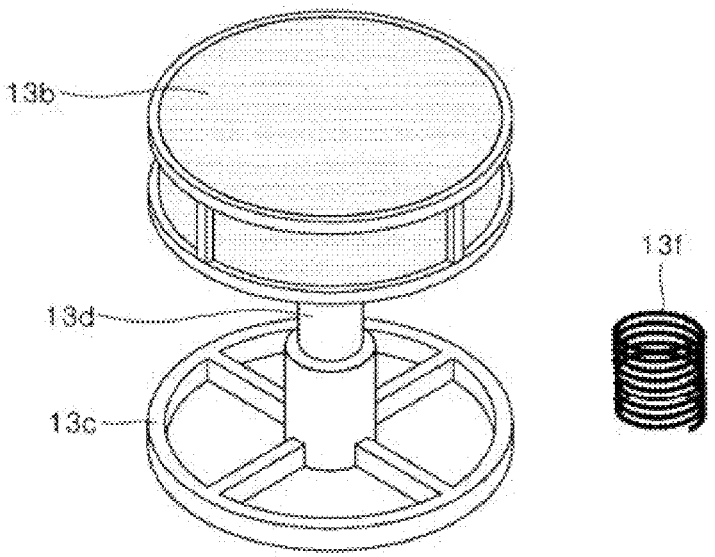
Figure 9:
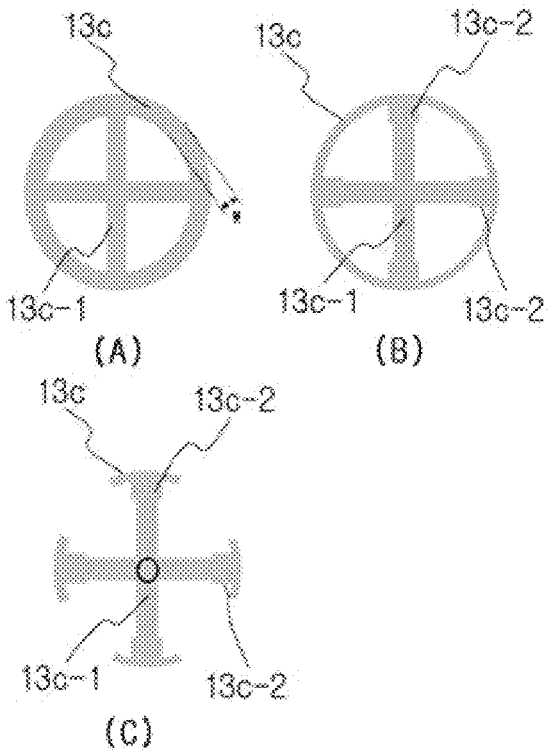

FIGS. 7 to 9 are a view showing an embodiment of a valve cap.

FIG. 7 is a view showing the detailed structure of a valve. The valve is composed of a valve head 13*b* preventing leakage of a concentrate at the chamber 13 and the container outlet 35-1 of the concentrate container, a valve pusher 13*c* pushing up the valve head 13*b* by being pushed by the inlet side of the drinking container outlet (the portion indicated by the arrow E in FIG. 5), a valve connection rod 13*d* connecting the valve pusher 13*c* and the valve head 13*b*, and a valve frame 13*e* on which the valve head 13*b* is mounted.

When the valve pusher 13*c* is pushed by the end of the drinking container neck 105 with the valve head 13*b* inside the valve frame 13*e*, as in the embodiment shown in FIG. 7, the valve head 13*b* is pushed out of the valve frame 13*e* (in FIG. 7, the left one shows the valve head 13*b* inside the valve frame 13*e* and the right one shows the valve head 13*b* pushed out of the valve frame 13*e*.

In this case, the valve frame 13*e* serves to fix the valve head 13*b*.

That is, the valve head 13*b* and the valve pusher 13*c* are maintained within a predetermined range by the valve frame 13*e*. Though not shown in the figures, the lower portion of the valve frame 13*e* is formed such that the valve head 13*c* is retained by the valve frame 13*e*, whereby the valve head

13*b* and the valve pusher 13*c* cannot move toward the assistant passage part 19 out of the predetermined range.

Further, the valve head 13*b* is prevented from moving toward the container outlet 35-1 out of the predetermined range by the lower portion of the valve frame 13*e*.

FIG. 8 is a view showing an embodiment of a structure that enables the valve connection rod 13*d* to be stretched in two steps (or two or more steps). That is, an elastic member (or a spring) 13*f* is disposed between the valve head 13*b* and the valve pusher 13*c*, so the valve head 13*b* is further pushed from the valve pusher 13*c* by the spring.

The steps are as follows.

1) The valve head 13*b* is fixed between the chamber 13 and the container outlet 35-1 by adhesion. The adhesion means attachment that can be broken when a force is applied.
2) When the valve connection rod 13*d* is pushed by the valve pusher 13*c*, the valve head 13*b* is pushed, so the valve head 13*b* is moved into the chamber 13 from between the chamber 13 and the container outlet 35-1.
3) The valve head 13*b* is further pushed by the elastic member 13*f*, so the valve head 13*b* is further moved into the chamber 13.

As a result, the concentrate in the chamber 13 can come more well out of the container outlet 35-1 of the mixing container.

FIG. 9 is a view showing the structures of valve pushers. The valve pusher 13*c* is pushed at the end of the neck 105 of the drinking container, but has to enable a concentrate or a mixture (a mixture of a concentrate and a drink) to move. Accordingly, the characteristics are as follows.

The valve pusher 13*b* should have an edge. Since the valve pusher 13*b* should be pushed by the end (the portion indicated by the arrow E in FIG. 5) of the drinking container neck 105, the valve pusher 13*b* should have an edge.

As shown in (A) of FIG. 9, the width w of the edge of the valve pusher 13*b* should be larger than the width of the end (the portion indicated by the arrow E in FIG. 5) of the drinking container neck 105. This is because the valve pusher 13*b* has to be pushed by the end of the drinking container neck 105.

As shown in (B) of FIG. 9, only portions 13*c*-2 of the edge of the valve pusher 13*b* may be formed thick and the other portions where the thick portions 13*c*-2 are not formed may be formed thin. That is, the other portions where the thick portions 13*c*-2 are not formed may be formed thinner than the end of the drinking container neck 105. This is because the portions that are pushed by the end of the drinking container neck 105 are the thick portions 13*c*-2.

As shown in (C) of FIG. 9, the edge of the valve pusher 13*b* may be partially formed and the edge sections may be formed thicker than the end of the drinking water neck 105.

Valve bars 13*c*-1 connecting the edge sections of the valve pusher 13*b* are provided. The valve connection rod 13*d* is connected to the intersection of the valve bars 13*c*-1 (the portion indicated by a circle in FIG. 9C). Obviously, the valve connection rod 13*d* may be formed at any position inside the valve pusher as long as it can be connected thereto.

Meanwhile, the valve pusher, the valve bars, the edge sections, and the thick portions may be integrated to reduce the manufacturing cost. Depending on cases, a portion or the entire of the valve connection rod 13*d* is also integrally formed.

Figure 10:
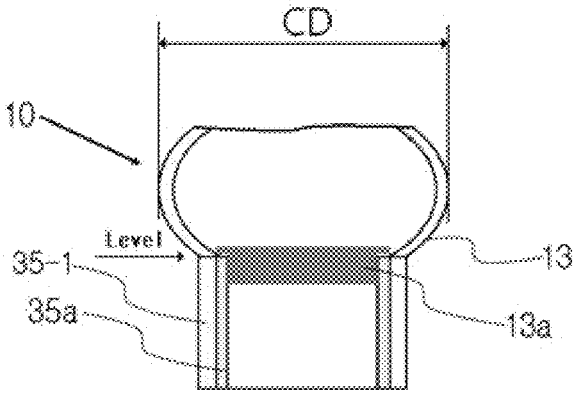
FIGS. 10 and 11 are views showing a method according to design conditions.
Figure 11:
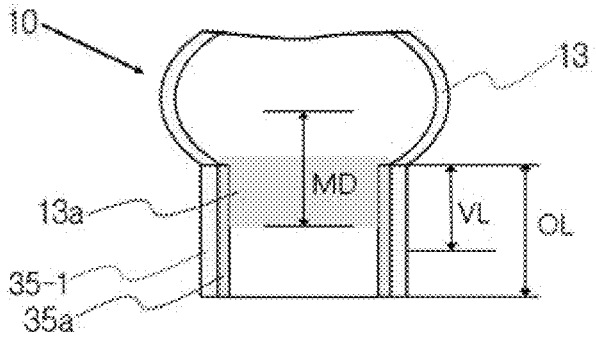

FIGS. 10 and 11 are views showing a method according to design conditions.

As shown in FIG. 10, the diameter CD of the concentrate container chamber 13 should be larger than the size of the container outlet 35-1. This is because a predetermined volume should be secured for the concentration container. The mixing container 10 of the present disclosure may be applied to a portable drinking container 100 and the capacity of a portable drinking container 100 for one person is usually 500 ml, so the capacity of the chamber 13 of the concentrate container should be determined to correspond thereto. That is, the size of the concentrate container chamber 13 may not be over 500/3 ml at the most. Assuming that dilution is made about 15 times at the most, the capacity of the concentrate container chamber 13 should be 33.3 ml (500/15 ml).

In order to fully discharge the concentrate (mixture) in the chamber 13 to the container outlet 35-1, the chamber 13 should be positioned even over a horizontal line (indicated by the arrow "level" in FIG. 10) when the interface between the chamber 13 and the container outlet 35-1 is horizontally extended.

FIG. 11 shows a distance that the valve cap 13*a* moves or the region in which the valve cap 13*a* is positioned.

The length VL at which the valve cap 13*b* is positioned in the container outlet 35-1 is smaller than the length OL of the outlet 35. The neck 105 of the drinking container is coupled in the container outlet 35-1 of the mixing container by thread-fastening (rotating), but the valve cap 13*b* may not be positioned within the distance in which the neck 105 of the drinking container 105 can be inserted in the container outlet 35-1 without thread-fastening.

The length VL at which the valve cap 13*b* is positioned is a maximum available length of the valve cap 13*b*. Further, the length is the length of the valve cap 13*a* in the embodiment shown in FIG. 5, but is a length including the valve pusher 13*c* and the valve head 13*b* in the embodiment shown in FIGS. 7 and 8.

In the embodiment shown in FIG. 8, the valve connection rod 13*d* can be stretched in two or more steps by the elastic member, and accordingly, the movement distance MD of the valve cap 13*a* is larger than the movement distance of the end (the portion indicated by the arrow E in FIG. 5) of the drinking container neck 105. If the elastic member is not provided, the distance MD is the same as the movement distance of the end (the portion indicated by the arrow E in FIG. 5) of the neck 105.

Figure 12:
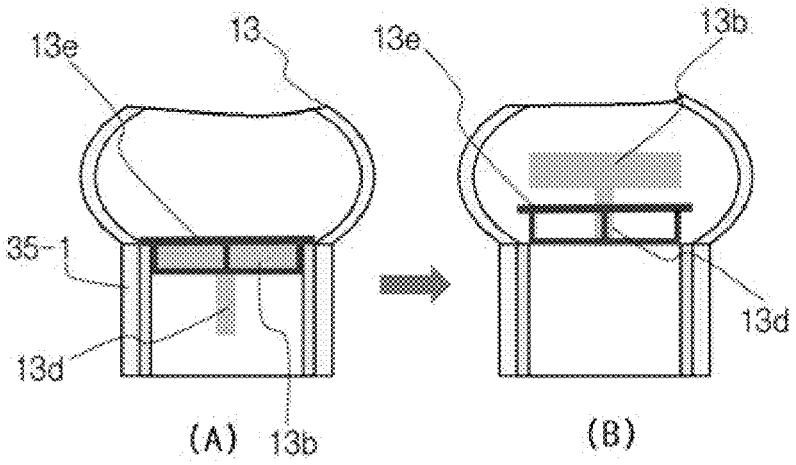
FIGS. 12 and 13 are views showing a way the outlet of the concentrate container is opened by the valve cap.
Figure 13:
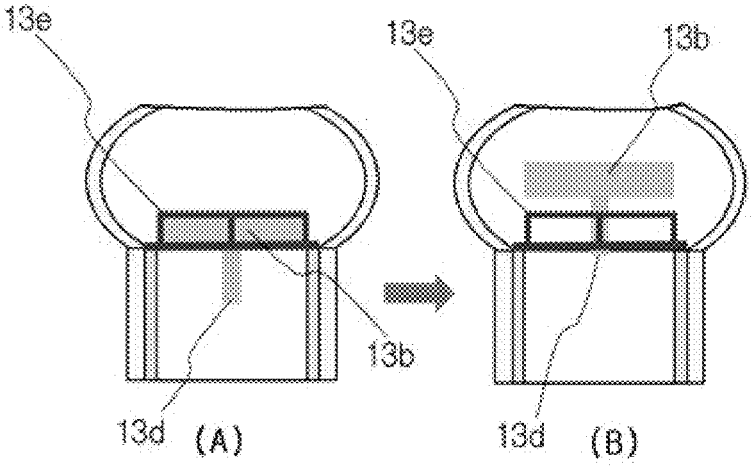

FIGS. 12 and 13 are views showing a way the mouth of the concentrate container is opened by the valve cap.

The valve head 13*b* mounted inside the valve frame 13*e* is pushed out of the valve frame 13*e* and inserted into the chamber 13 by the valve connection rod 13*d*. The chamber 13 is opened, so the concentrate (mixture) can be discharged to the container outlet 35-1.

The initial position of the valve head 13*b* is in the container outlet 35-1 in FIG. 12 and the initial position of the valve head 13*b* is in the chamber 13 in FIG. 13. Obviously, depending on cases, the initial position of the valve head 13*b* may extend over both the chamber 13 and the container outlet 35-1.

Meanwhile, the valve pusher c is not shown in the figures.

Figure 14:
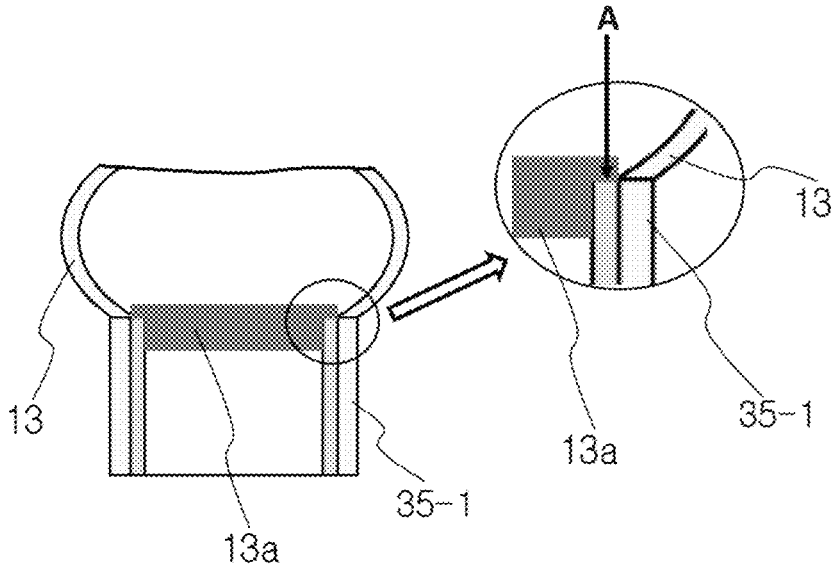
FIG. 14 is a view showing the sealed state between a chamber and the outlet.

FIG. 14 is a view showing the sealed state between a chamber and the outlet.

A stepped portion is formed at the valve cap 13*a* for closing the container outlet 35-1, thereby increasing the sealing effect. The joint (the portion indicated by an arrow A in FIG. 14) between the valve cap 13*a* and the upper end of the container outlet 35-1 is bonded. That is, it means attachment that is broken when a force is applied. Elastic resin or rubber is used for the valve cap 13*a* at the joint.

The valve frame 13*e* may take the charge at the joint (the portion indicated by an arrow in FIG. 14) between the valve cap 13*e* and the upper end of the container outlet 35-1 (see FIGS. 12 and 13).

The concentrate container mouth 19 and the mixing container cap 80 are not shown for convenience in FIG. 6 and FIGS. 10 to 14, but, of course, the assistant passage part 19 and the mixing container cap 80 substantially exist as in the embodiment of FIGS. 1 and 2.

Another Embodiment

FIGS. 15 to 19 are views showing an embodiment further including a connector.

Figure 15:
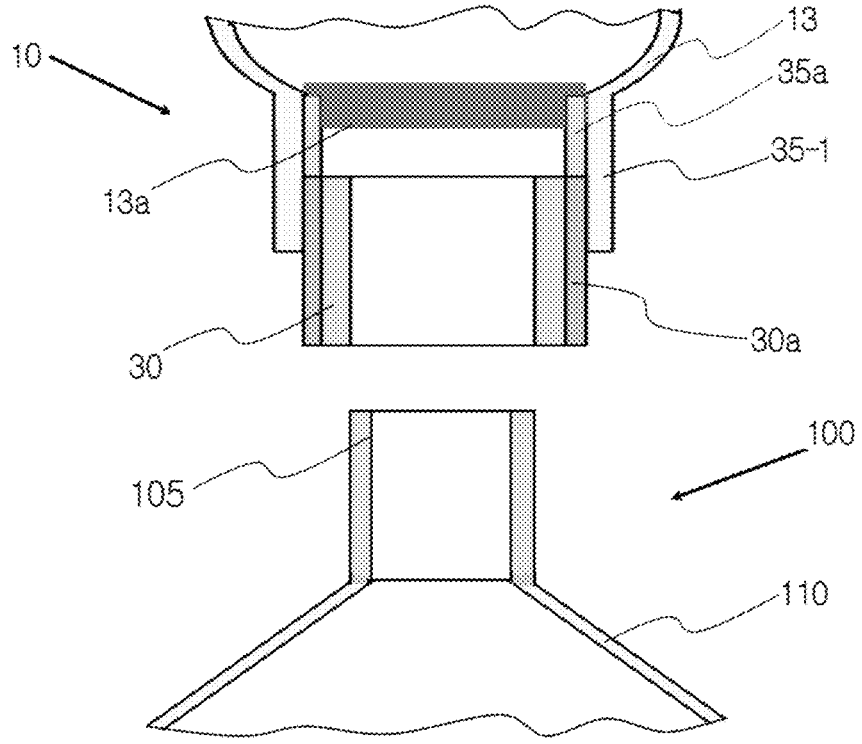
FIGS. 15 to 19 are views showing an embodiment further including a connector.
Figure 16:
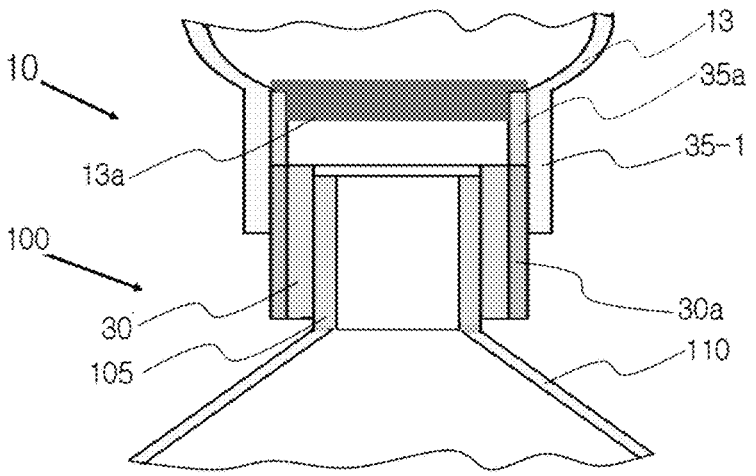

As in the embodiment of FIG. 15, a connector 30 is further provided at the container outlet 35-1 of the mixing container. Further, as in the embodiment of FIG. 16, the connector thread of the connector 30 and the thread of the drinking container neck 105 are thread-fastened by rotation, whereby the connector 30 and the drinking container neck 105 are coupled.

Figure 17:
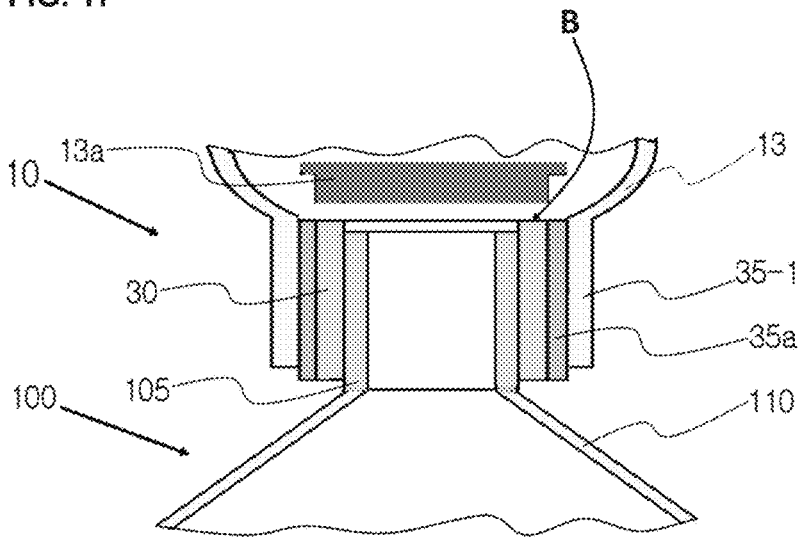

Further, as in the embodiment of FIG. 17, when the connector 30 is moved in the container outlet 35-1 toward the chamber 13 by rotation between the thread formed on the outer side of the connector 30 and the outlet thread 35*a*, the end (the portion indicated by an arrow B in FIG. 17) of the connector 30 pushes the valve cap 13*a*.

Accordingly, the concentrate can move between the chamber 13 and the container outlet 35-1.

As various methods of pushing the valve cap 13*b* in this embodiment, the method of the first embodiment can be applied.

Figure 18:
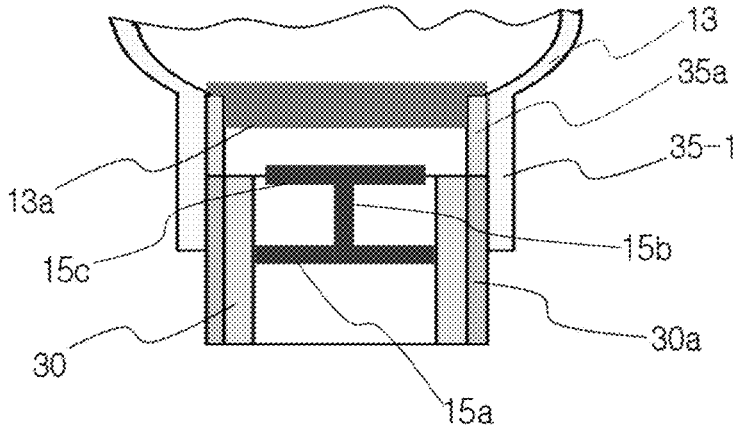

FIG. 18 is a view showing an embodiment in which a pusher is mounted inside the connector.

Although the end (the portion indicated by an arrow in FIG. 17) of the connector 30 can push the valve cap 13*a*, a pusher may be disposed inside the connector 30 to push the valve cap 13*a*.

As in the embodiment of FIG. 18, the pusher disposed inside the connector 30 is composed of a pusher head 15*c* for pushing the valve cap 13*a*, a pusher arm 15*a* supporting the pusher, and a pusher connection rod 15*b* connecting the pusher arm 15*a* and the pusher head 15*c*.

The structure of the pusher disposed in the connector 30 is similar to the valve structure shown in FIGS. 7 and 8. That is, the pusher arm 15*a*, as in the embodiment of FIG. 19, has a structure that supports the pusher connection rod 15*b* inside the connector 30 and is open to allow for movement of liquid. The pusher connection rod 15*b* is formed like a bar to connect the pusher head 15*c* and the pusher arm 15*a* and support the pusher head 15*c* on the pusher arm 15*a*.

Since the pusher head 15*c* pushes the valve cap 13*a*, it may be formed in a plate shape. In this case, the pusher head 15*c* is formed in a plate shape but may be partially open to allow for movement of liquid like the shape of the valve pusher 13*c* shown in FIGS. 7 and 8.

Figure 19:
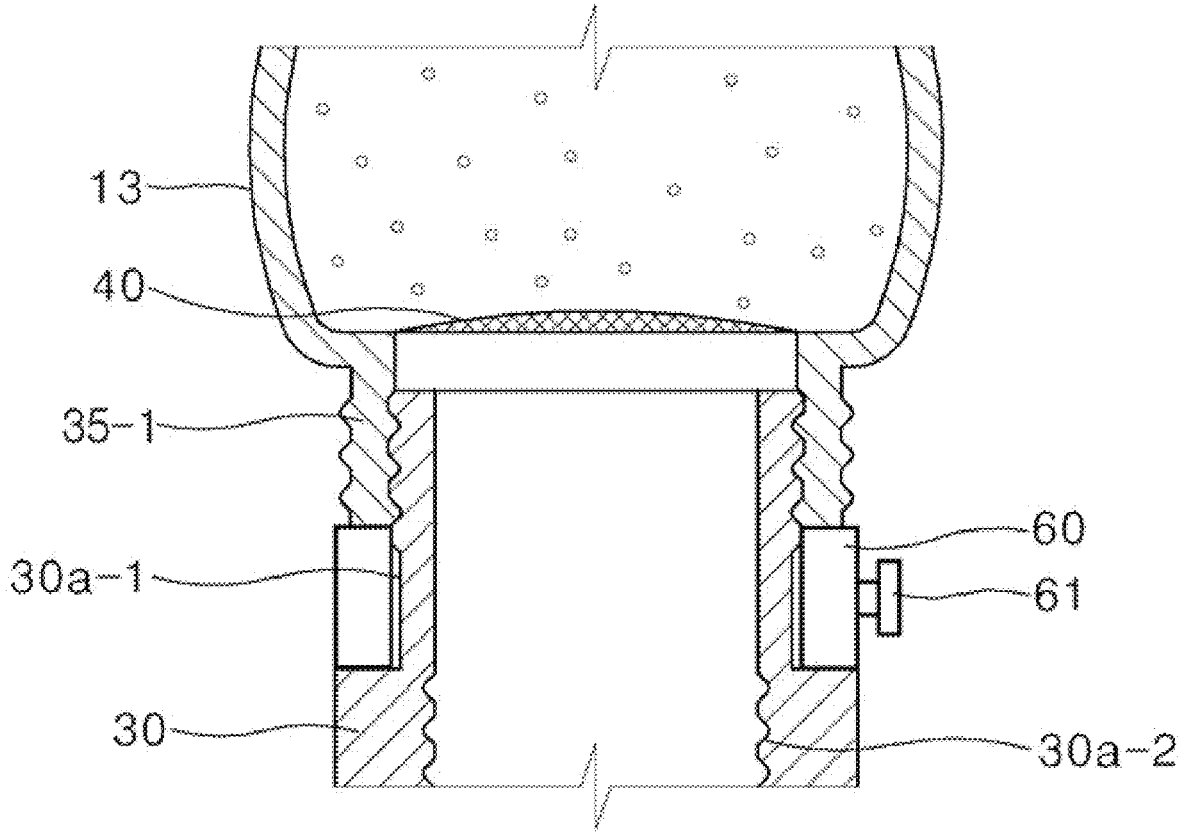

FIG. 19 is a view showing another embodiment of a connector. The neck 105 of the drinking container is coupled to the lower portion (the lower portion in the figure) of the connector 30 and the container outlet 35-1 of the chamber is coupled to the upper portion (the upper portion in the figure) of the connector 30.

In this case, the drinking container neck 105 is inserted in the connector 30 and coupled by thread-fastening, and the outer side of the connector 30 is inserted in the container outlet 35-1 of the chamber and coupled by thread-fastening.

A chamber coupling thread 30*a*-1 and a drinking container coupling thread 30*a*-2 may exist at different positions on the connector and may be formed in a method of forming a stepped portion. That is, the thickness of the connector 30 at the portion at which the chamber coupling thread 30*a*-1 is formed may be smaller than the thickness of the connector 30 at the portion at which drinking container coupling thread 30*a*-2 is formed.

A spacer 60 and a spacer handle 61 are provided at the container outlet 35-1 and the thick portion of the connector, thereby fixing the connector 30 and the outlet 35 of the chamber such that they cannot be moved. Accordingly, when a user removes the spacer 60 using the fixing handle 61, the connector 30 and the container outlet 35-1 can be moved with respect to each other.

Though not shown in the figure, a cap that covers the connector 30 is provided.

Another Embodiment

Figure 20:
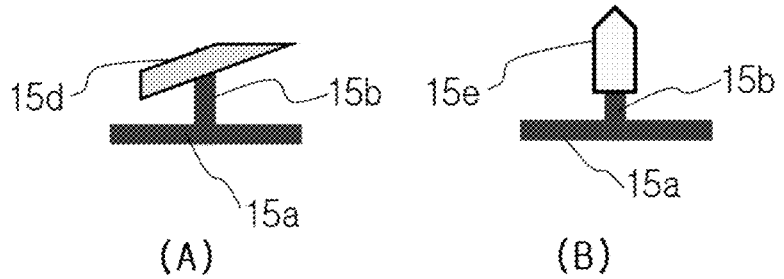
FIG. 20 is a view showing different types of pushers in the connector.

FIG. 20 is a view showing different types of pushers in the connector.

(A) of FIG. 20 is a view showing an embodiment in which a pusher blade 15 is provided instead of the pusher head 15*c* and (B) of FIG. 20 is a view showing an embodiment in which a pusher protrusion 15*e* is provided instead of the pusher head 15*c*.

In order to provide the pusher blade 15*d* instead of the pusher head 15*c*, a blocking film (not shown in the figures) should be provided instead of the valve cap 13*b*. The blocking film may be a film that is made of resin or plastic to be able to be torn and prevents leakage of fluid. Accordingly, the blocking film keeps a concentrate in the chamber 13, but when it is torn by the pusher blade 15*d*, the concentrate comes out of the chamber 13 to the container outlet 35-1.

In order to provide the pusher protrusion 15*e* instead of the pusher head 15*c*, a breaking structure (which is not shown in the figures and may be a film or a diaphragm formed to be broken by the pusher protrusion 15*e*) should be provided instead of the valve cap 13*b*. The pusher protrusion 15*e* is a structure that is thicker than the blocking film but is broken by a pointed part, and may be made of plastic or resin. Accordingly, the breaking structure keeps a concentrate in the chamber 13, but when it is torn by the pusher protrusion 15*e*, the concentrate comes out of the chamber 13 to the container outlet 35-1.

The principle of moving the pusher blade 15*d* or the pusher protrusion 15*e* toward the chamber 13 to tear the blocking film or the breaking structure is the same as that in the previous embodiment.

The pusher arm 15*a* is further provided so that the pusher blade 15*e* or the pusher protrusion 15*e* is fixed on the inner surface of the connector 30. The pusher arm 15*a* is formed like a bar and is connected to the inner surface of the connector 30. However, as long as the pusher blade 15*d* or the pusher protrusion 15*e* are connected to the inner surface of the connector 30, the shape of the pusher arm 15*a* is not limited to a bar shape.

Figure 21:
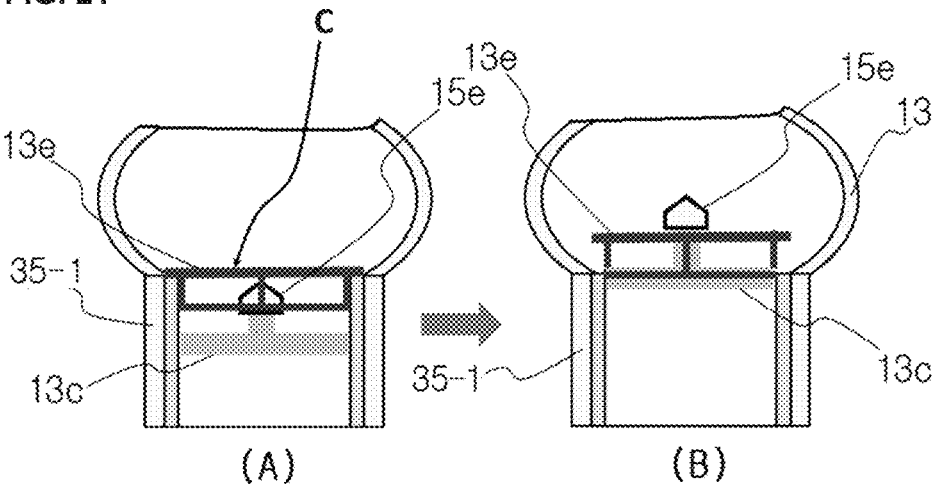
FIG. 21 is a view showing an embodiment in which a pusher protrusion or a pusher blade can be used in the method of the first embodiment.

FIG. 21 is a view showing an embodiment in which a pusher protrusion or a pusher blade can be used in the method of the first embodiment.

A film or a thin plate structure that can be broken by the pusher blade 15*d* or the pusher protrusion 15*e* is disposed over the pusher frame 13*e* (the portion indicated by an arrow C in (A) of FIG. 21), and when the valve pusher 13*c* is pushed by the upper portion (the portion indicated by E in FIG. 5) of the drinking container neck 105, the pusher protrusion 15*e* (or the pusher blade 15*d*) is moved up.

The film or the thin plate structure is broken by the pusher protrusion 15*e* (or the pusher blade 15*d*).

Finally, the pusher frame 13*e* is moved up by the valve pusher 13*c*, so the film or the thin plate structure that can be broken is fully moved up and a concentrate in the chamber 13 is more actively moved.

Meanwhile, the pusher protrusion 15*e* (or the pusher blade 15*d*) may be moved in two steps, as in the embodiment of FIG. 8, so it can be moved longer than the movement distance of the upper portion (the portion indicated by E in FIG. 5) of the neck 105 of the drinking container (see the description of the embodiment of FIG. 11).

As a result, the film, breaking structure, or valve cap should be pushed over the interface between the chamber 13 and the container outlet 35-1. The pushing part in this case is the pusher blade, the pusher protrusion, or the pusher head.

Another Embodiment

FIGS. 22 to 29 are views showing another embodiment of opening the valve cap.

Figure 22:
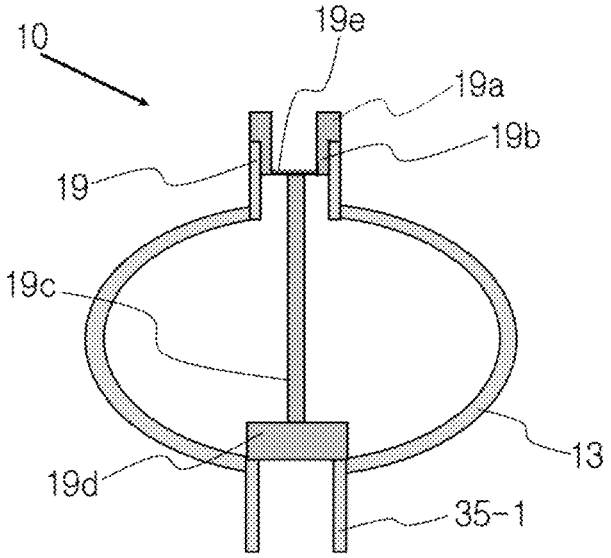
FIGS. 22 to 25 are views showing another embodiment of opening the valve cap.
Figure 23:
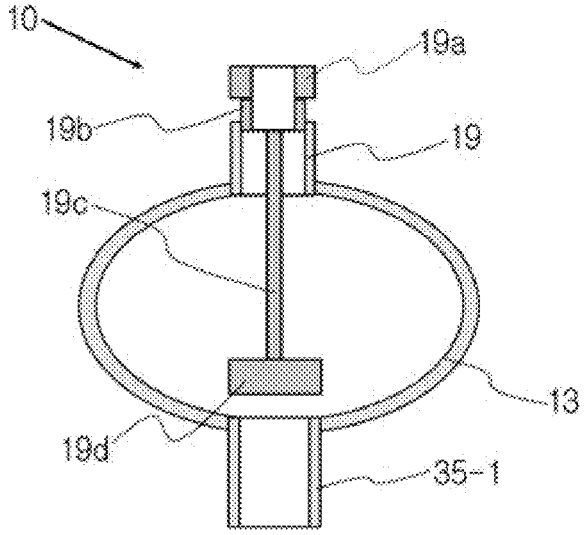
Figure 24:
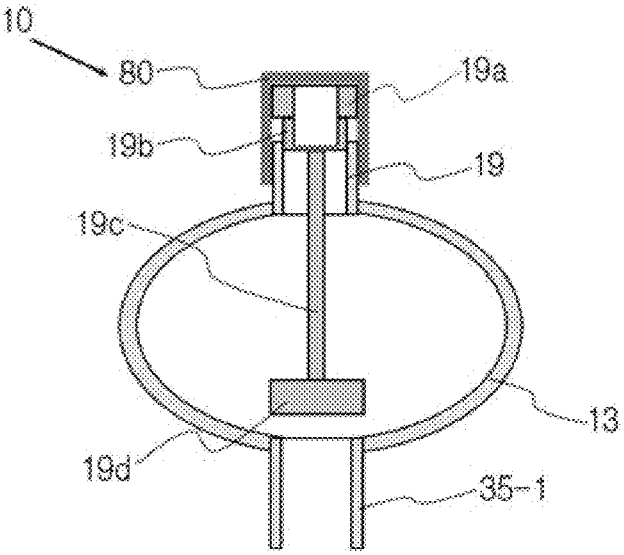

As in FIGS. 22 to 24, a mouth handle 19*a* is disposed at the upper end (the upper end in the figures) of the assistant passage part 19, a mouth insertion portion 19*b* that is inserted in the container mouth 19 is disposed at the lower end of the mouth handle 19*a*, a vertical movable valve 19*d* is disposed at the inlet of the chamber 13, and a vertical movable valve 19*d* is connected with the mount insertion portion 19*b* through a valve connection bar 19*c*. The valve connection bar 19*c* is supported by a valve support portion 19*e* provided inside the mount insertion portion 19*b*. The diameter of the container mouth 19 should be larger than the diameter of the vertical movable valve 19*d* (so that the vertical movable valve 19*d* can be inserted into the container mouth 19 when the product is assembled).

FIG. 22 shows the state in which the mouth insertion portion 19*b* at the lower end (the lower end in the figure) of the mouth handle 19*a* is inserted. When the mouth handle 19*a* is turned and pulled up (upward in the figure) from the assistant passage part 19, the mouth insertion portion 19*b* is exposed out of the assistant passage part 19, as in FIG. 23. In the state of FIG. 23, the vertical movable valve 19*d* is also moved by the valve connection bar 19*c* connected with the valve support portion 19*e* inside the mouth insertion portion 19*b*, so the chamber 13 is opened.

When the chamber 13 is opened, the concentrate in the chamber can be moved out of the chamber.

Figure 25:
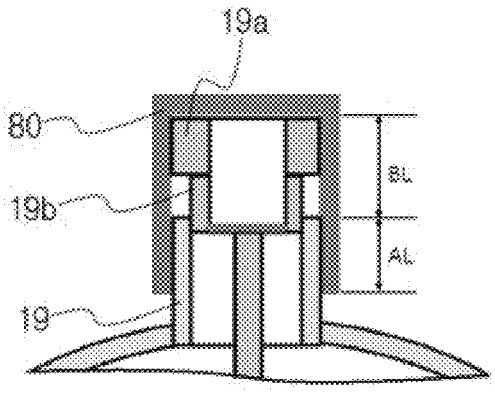

FIGS. 24 and 25 are views showing an embodiment of the size of a cap that covers the container mouth.

The size of the cap covering the container mouth can be fitted to the container mouth in the first, second, and third embodiments. However, the size of the mixing container cap 80 covering the assistant passage part 19 should be increased in this embodiment.

As in FIG. 24, the mixing container cap 80 should be manufactured in consideration of the length when the mouth handle 19*a* is moved up over the assistant passage part 19 and the mount insertion portion 19*b* comes out of the assistant passage part 19. This is for preventing the mouth insertion portion 19*b* coming out of the assistant passage part 19 from going back into the assistant passage par 19 when the mixing container cap 80 is closed.

That is, it means that, as shown in FIG. 25, when that the distance of the mouth handle 19*a* and the mouth insertion portion 19*b* that are exposed out of the assistant passage part 19 is BL, the length BL should be included in the length of the mixing container cap 80.

It means that the length of the mixing container cap 80 should be larger than the sum of the distance AL of the region at which the assistant passage part 19 and the cap are coupled and the distance BL. The gap between the mouth handle 19*a* and the mixing container cap 80 and the thickness of the mixing container cap 80 are also reflected in the length of the mixing container cap 80.

Figure 26:
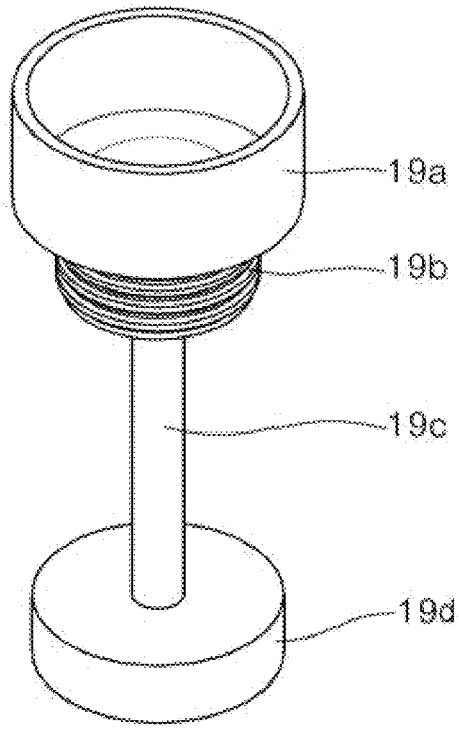
FIGS. 26 to 28 are views showing an embodiment of an outlet handle 19*a* and a vertical movable valve 19*d;*
Figure 27:
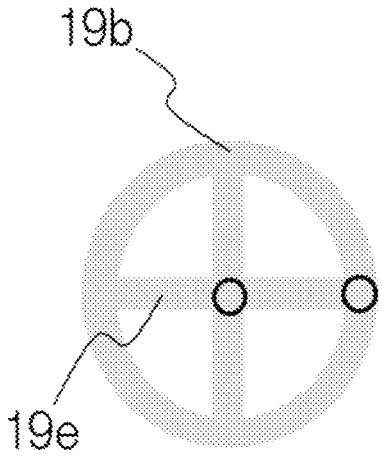
Figure 28:
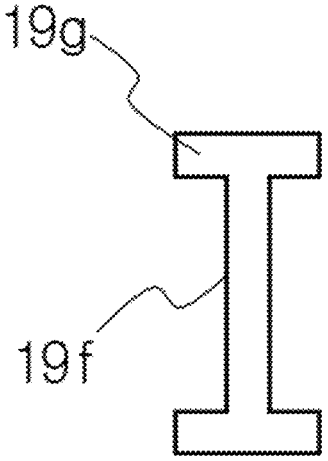

FIGS. 26 to 28 are views showing an embodiment of the mouth grip 19*a* and the vertical movable valve 19*d*.

The mouth handle 19*a* is exposed out of the assistant passage part 19*a* and can be pulled out away from the assistant passage part 19 (thread-rotation is used as a method of the embodiment in the present disclosure). To this end, threads are formed on the outlet insertion portion 19*b*. When the mouth handle is maximally pulled out, the mouth insertion portion 19*b* is exposed, and a stopper may be further provided to prevent the mouth insertion portion 19*b* from going back into the assistant passage part 19 in this state. The structure of the stopper is not described in described in detail herein a common method of a stopping step can be used.

Further, as shown in FIG. 27, a valve support portion 19*e* is formed inside the mouth insertion portion 19*b* and the vertical movable valve 19*d* is connected to the valve support portion 19*e*. Accordingly, when the mouth insertion portion 19*b* is moved out of the assistant passage part 19, the vertical movable valve 19*d* is also moved toward the outlet of the assistant passage part, so the concentrate in the chamber 13 moves out of the chamber 13.

FIG. 27 shows the mouth insertion portion 19 seen from the bottom. This is a plan view under the assumption that the valve connection bar 19*c* has been removed. As shown in the figure, the valve support portion 19*e* is connected with the mouth insertion portion 19*b*, and an opening through which a concentrate or a drink moves is provided between the mouth support portion 19*e* formed in an arm or bar shape and the mouth insertion portion 19*b*.

Further, the valve connection bar 19*c* is connected to the portions indicated by small circles in FIG. 27. Obviously, the connection position is not limited to the portions indicated by circles, and the valve connection bar is separated in terms of function, but may be integrally formed by injection molding.

Further, an elastic member is attached to the entire of the edge of the lower end of the vertical movable valve 19*d* which is the portion being in contact with the chamber 13 or the container outlet 35-1, or the lower surface of the vertical movable valve 19*d* in order to achieve a sealing effect. The elastic member may be resin or rubber having elasticity.

FIG. 28 is a view showing another method of moving the mouth handle 19*a* and the mouth insertion portion 19*b*. That is, the mouth insertion portion 19*b* and the assistant passage part 19 of the chamber are moved with respect to each other by thread-fastening in the embodiment of FIG. 26, but a method of straight movement or a method of preventing straight movement through left-right rotation may be used.

That is, a groove (a protrusion guide 19*f* and a supporting groove 19*g*) shown in FIG. 28 is formed on the outer surface of the mouth insertion portion 19*b* or on the inner surface of the assistant passage part 19 of the chamber. A protrusion (not shown in the figure) is provided on the opposite surface (e.g., on the inner surface of the assistant passage part 19 when the groove is formed on the outer surface of the mouth insertion portion 19*b*).

The protrusion is moved up and down by the protrusion guide 19*f*, whereby the mouth insertion portion 19*b* and the assistant passage part 19 can be moved up and down with respect to each other. Further, the protrusion is moved left and right in the support groove 19*a* of the groove, relative up-down movement of the mouth insertion portion 19*b* and the assistant passage part 19 is prevented. That is, a user can move up and down or fix the mouth insertion portion 19*b* by hand.

Another Embodiment

FIGS. 29 to 32 are views showing embodiments including a connector and a cutter.

A connector 30 having a new structure different from that of the previous embodiment of the present disclosure is proposed in the embodiments as depicted in FIGS. 29 to 32. The connector has the outlet 35 and the outlet 35 is connected to the neck 105 of the drinking container 100. Accordingly, the discharging portion of the mixing container 10 is referred to as a discharge part 17 and the discharging portion of the connector 30 is referred to as an outlet 35 in the embodiments as depicted in FIGS. 29 to 32.

As shown in the figures, the connector 30 has a passage part 31 coupled to the mixing container 10 to communicate with the discharge part 17, and an outlet 35 coupled to the drinking container 10 so that an additive 5 flowing in the passage part 31 is discharged to the drinking container 100.

The passage part 31 of the connector 31 is thread-fastened to the discharge part 17 of the mixing container 10. Accordingly, a male thread is formed in a predetermined length on the outer surface of the passage part 31 and a female thread is formed in a predetermined length on the inner surface of the discharge part 17.

A female thread is formed on the inner surface of the outlet 35 and is engaged with the male thread of the neck 105 of the drinking container 100. Accordingly, the connector 30 can be conveniently mounted on the drinking container 100.

A stepped portion 37 that is a step is formed on the outer surface of the connector 30. A spacer 60 to be described below or an end of the mixing container 10 with the spacer 60 cut off may be in close contact with the stepped portion 37.

The blocking film 40 is disposed at the discharge part 17 of the mixing container 10 and blocks the discharge part 17. The blocking film 40 in this embodiment has a thin sheet shape made of synthetic resin, smoothly protruding at the center portion, and being thin at the edge, and is supported on the inner surface of the discharge part 17 of the mixing container 10 to be able to be easily broken by an external force. As described above, since the mixing container 10 has the blocking film 40, the additive 5 in the chamber 13 can be stably kept.

The connector 30 has a cutter 50 in consideration of the configuration that the blocking film 40 is provided at the mixing container 10. The cutter 50 cuts the blocking film 40 provided at the mixing container 10 by moving relatively to the mixing container 10.

In this embodiment, the cutter 50 spirally protrudes from the front end of the passage part 31 of the connector 30. The cutter 50 is made of PC (polycarbonate) or polypropylene that has strength the same as or larger than that of PET to be able to cut well the blocking film 40. A metallic thin film may be additionally attached to the cutting surface of the cutter to increase the cutting ability.

Accordingly, when the mixing container 10 is moved with respect to the connector 30 through thread-rotation, the edge of the blocking film 40 mounted on the inner surface of the discharge part 17 of the mixing container 10 is brought in contact with and cut by the cutter 50 at the front end of the connector 30. As the blocking film 40 is cut, the discharge part 17 of the mixing container 10 is opened and the discharge part 17 of the mixing container 10 communicates with the passage part 31 of the connector 30, so the additive 5 in the mixing container 10 flows to the passage part 31 of the connector 30 through the discharge part 17.

Meanwhile, a mixing container unit 1*a* of the present disclosure further includes a spacer 60 that maintains the gap between the mixing container 10 and the connector 30.

The spacer 60 has a band shape with a predetermined width and is provided to be able to be separated from an end of the mixing container 10, for example, to be able to be cut from an end of the mixing container 10. The spacer 60 maintains the gap between the mixing container 10 and the connector 30 to prevent the cutter 50 from cutting the blocking film 40 when the mixing container 10 and the connector 30 are initially assembled. The width of the spacer 60 may be larger than or the same as the gap between the cutter 50 and the blocking film 40.

A protrusion that can be held by hand is formed on a side of the spacer 60. Accordingly, it is possible to conveniently cut the spacer 60 from an end of the mixing container 10 while holding the protrusion by hand.

Figure 29:
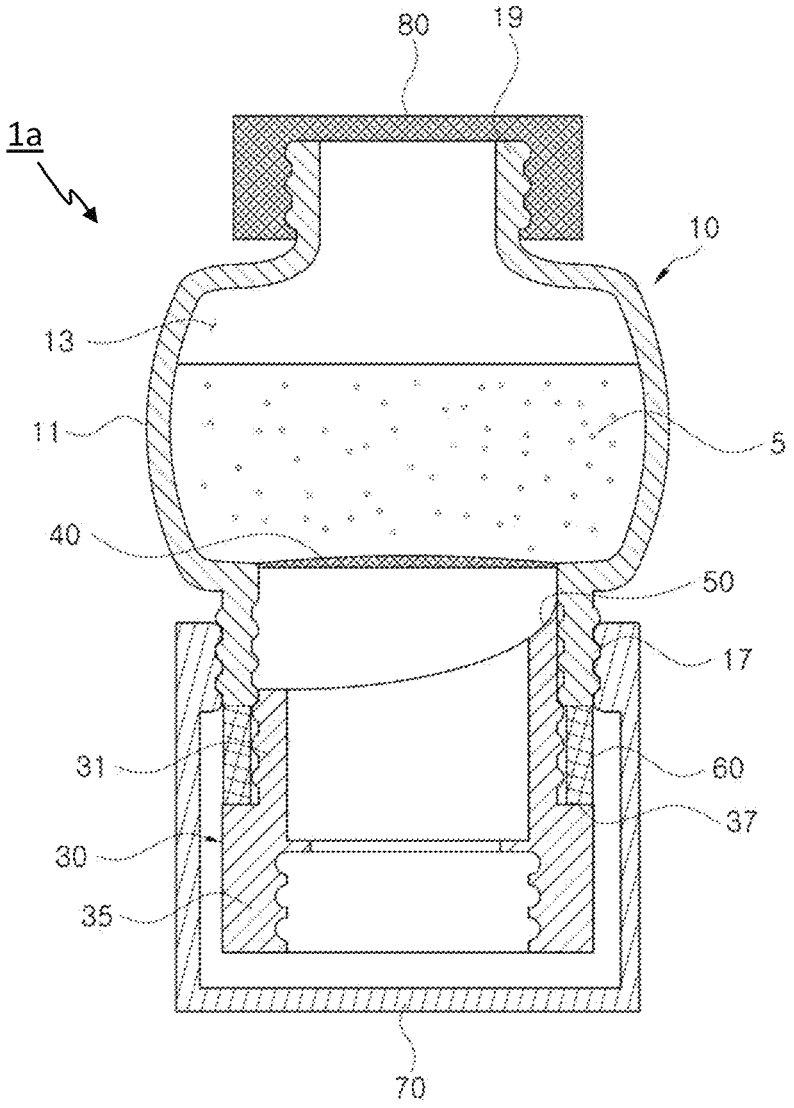
FIGS. 29 to 32 are views showing embodiments including a connector and a cutter.

The mixing container unit 1*a* of the present disclosure, as in FIG. 29, further includes a connector cap 70. The connector cap 70 has a cylindrical shape with an open side and is separably thread-fastened to the outer surface of the discharge part 17 of the mixing container 10.

Accordingly, it is possible to cover and protect the connector 30 coupled to the mixing container 10 by coupling the connector cap 70 to the mixing container 10. In particular, it is possible to fundamentally prevent foreign substances from entering the outlet 35 of the connector 30 from the outside while the mixing container unit 1*a* according to the present disclosure is stored and distributed.

The mixing container unit 1*a* according to the present disclosure further includes an assistant passage part 19 and a mixing container cap 80.

The assistant passage part 19 protrudes from another end of the container body 11 to communicate with the chamber 13. Since the assistant passage part 19 is provided, a user can inject and use a desired additive 5 in the mixing container 10 through the assistant passage part 19. Further, it may be possible to drink the mixture 120 mixed with the additive 5 in the drinking container 100 through the assistant passage part 19 with the mixing container unit 1*a* according to the first embodiment of the present disclosure mounted on the drinking container 100.

The mixing container cap 80 is provided to be separable from the assistant passage part 19 and opens/closes the assistant passage part 19. The mixing container cap 80 is thread-fastened to the assistant passage part 19 in this embodiment, but is not limited thereto and, though not shown, the mixing container cap may be held at a free end of a connection band and may be separably fitted to the assistant passage part.

Since the connector cap 70 and the mixing container cap 80 are provided, as described above, the mixing container unit 1*a* according to the first embodiment of the present disclosure may be packed as a single product without being mounted on the drinking container 100, so the volume of the entire product becomes small. Accordingly, not only storage and distribution are easy, but the distribution cost can be reduced.

The process of using the mixing container unit 1*a* having this configuration according to an embodiment of the present disclosure is described hereafter.

First, the outlet 35 of the connector 30 is opened by separating the connector cap 70 of the mixing container unit 1*a* according to the present disclosure from the mixing container 10. In this process, since the gap between the cutter 50 and the blocking film 40 is maintained by the spacer 60 disposed at an end of the mixing container 10, so the blocking film 40 is not cut and the additive 50 is kept in the chamber 13 of the mixing container 10.

Figure 30:
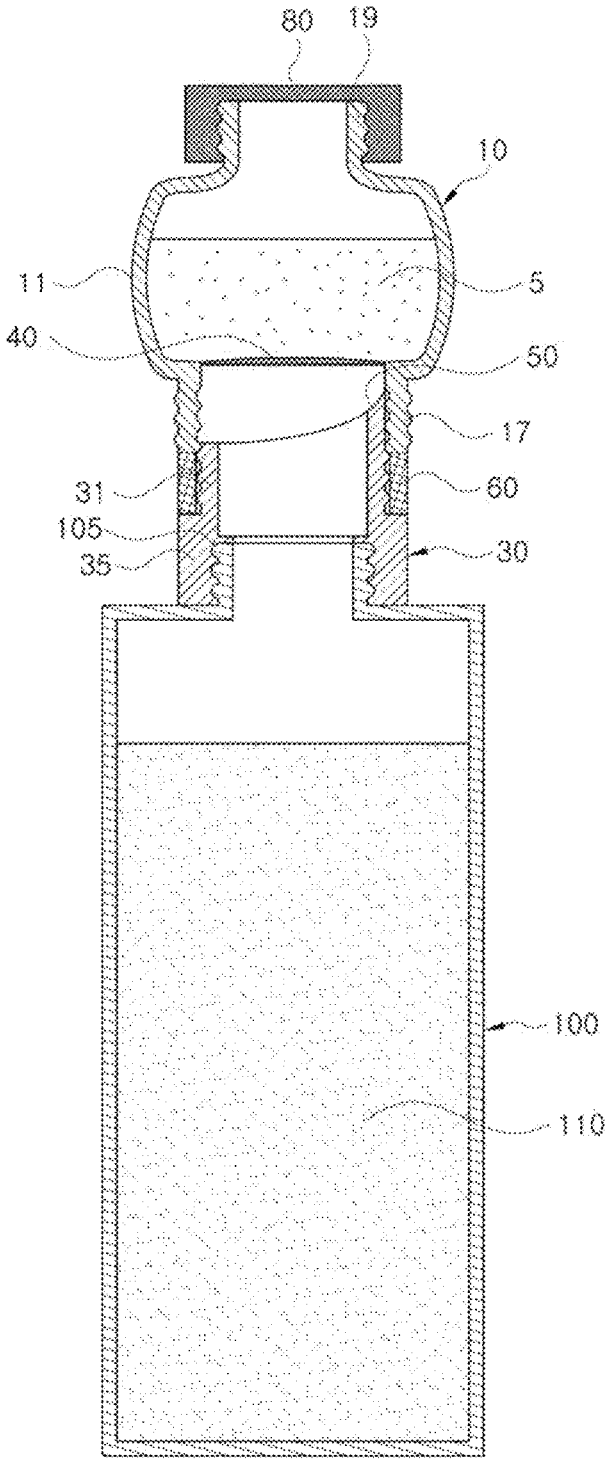

Next, the outlet 35 of the connector 30 is coupled to the neck 105 of the drinking container 100, whereby, as shown in FIG. 30, the mixing container unit 1*a* according to the first embodiment of the present disclosure is mounted on the drinking container 100.

After the mixing container unit 1*a* is mounted on the drinking container 100, the spacer 60 is cut and separated from the end of the mixing container 10.

Next, the mixing container 10 is thread-rotated with respect to the connector 30 such that the mixing container 10 is moved close to the connector 30, for example, an end of the mixing container 10 is brought in close contact with the stepped portion 37 of the connector 30, whereby the mixing container 10 moved with respect to the connector 30. In this process, the cutter 50 of the connector 30 cuts the edge of the blocking film 40.

As the blocking film 40 is cut, the discharge part 17 of the mixing container 10 is opened, and the discharge part 17 of the mixing container 10 and the passage part 31 of the connector 30 communicate with each other.

Further, the additive 5 in the mixing container 10 flows into the passage part 31 of the connector 30 through the discharge part 17 and keeps flowing into the drinking container 100 through the outlet 35, whereby, as shown in FIG. 4, the additive 5 is mixed with the drink 110 kept in the drinking container 100.

Accordingly, the additive 5 kept in the mixing container 10 and the drink 110 kept in the drinking container 100 are mixed at an optimal ratio and a user can drink the mixture 120 mixed with the additive 5 with an optimal taste.

Meanwhile, when the additive 5 kept in the mixing container 10 and the drink 110 kept in the drinking container 100 are mixed, a user can simply adjust the mixing ratio of the additive 5 kept in the mixing container 10 and the drink 110 kept in the drinking container 100 and then can drink the mixture in accordance with his/her individual preference using the plurality of scale lines on the mixing container without using a separate measuring container.

Figure 31:
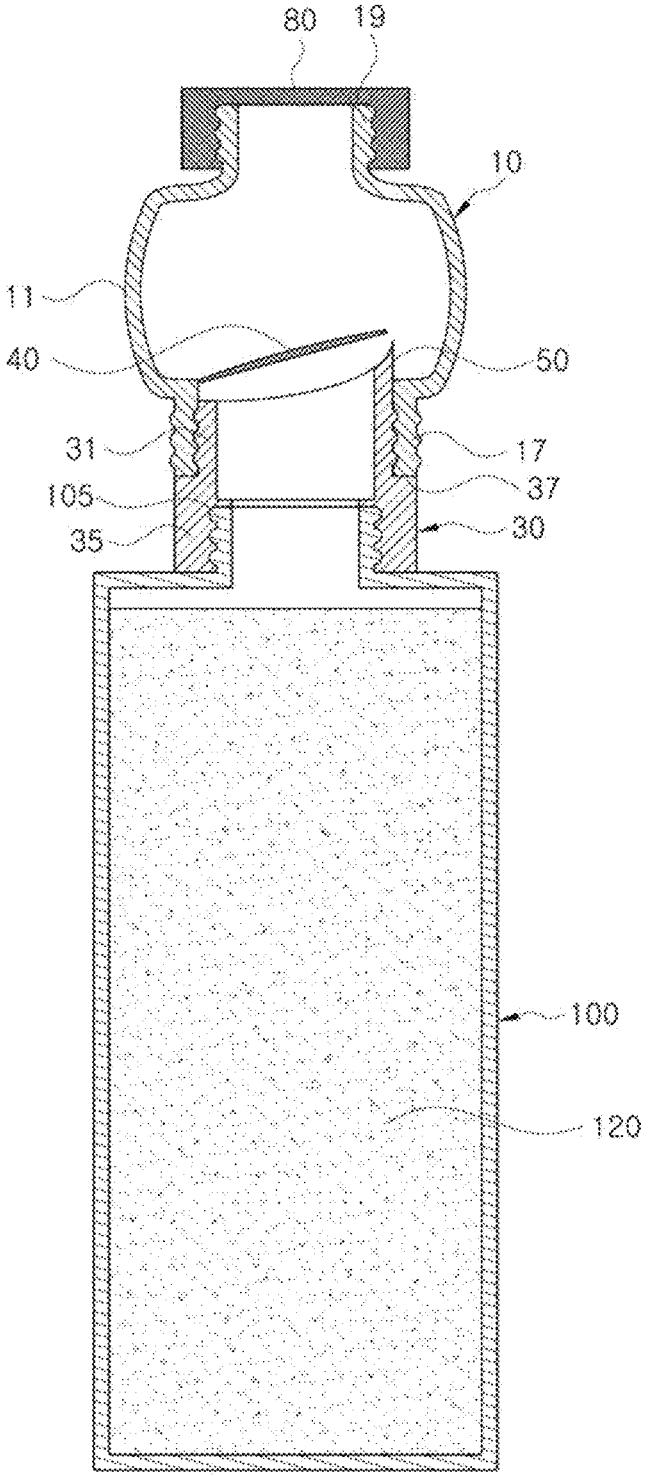

Further, since the mixing container unit 1*a* according to the first embodiment of the disclosure has a specific space therein, when the amount of the additive 5 kept in the mixing container 10 is larger than the empty space of the drinking container 100, as shown in FIG. 31, it is possible to simply mount the mixing container unit 1*a* on the drinking container 100 and drink the mixture.

Figure 32:
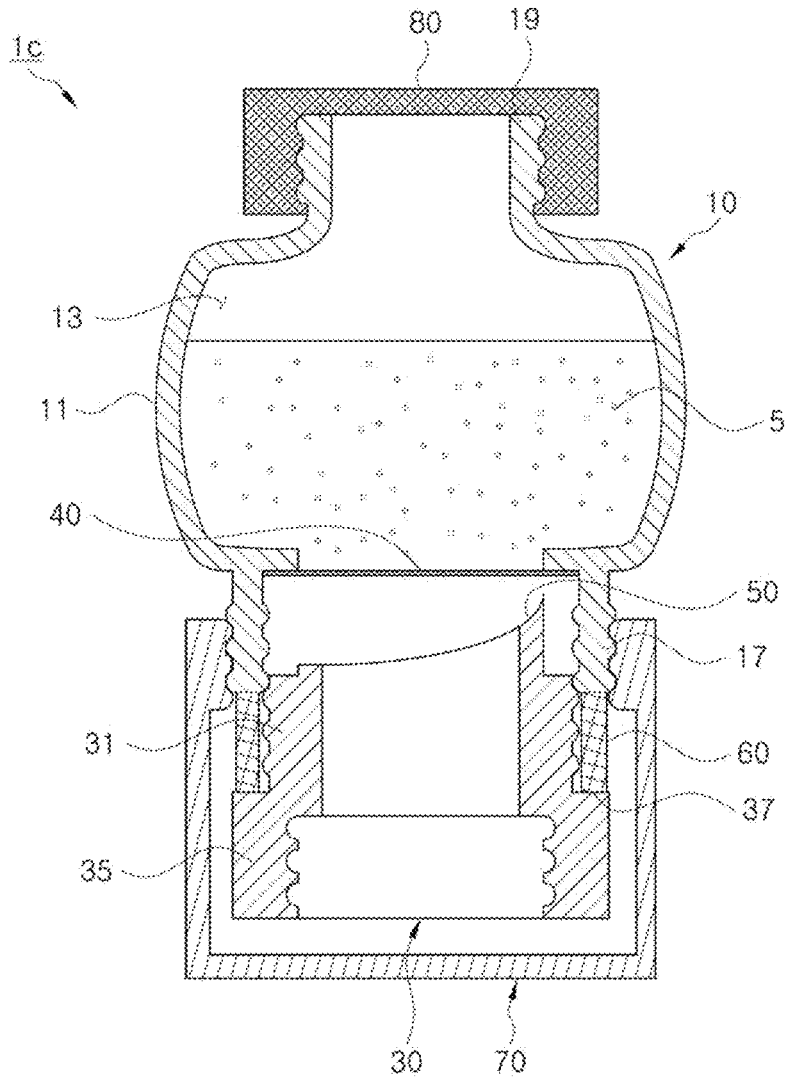

FIG. 32 shows another example in which a cap 70 is separably fitted on the discharge part 17 of the mixing container 10. As yet another example, a thread may be formed on the lower portion of the mixing container 10 so that the lower portion of the mixing container and the cap 70 can be coupled to and separate from each other by threads, That is, the cap 70 may be formed to be able to be directly coupled to and separated from the mixing container 10.

A mixing container unit 1*c* according to the present disclosure as shown in FIG. 32 has a blocking film 40 that is a sealing sheet membrane thermally bonded to the discharge part 17 of the mixing container 10.

Another Embodiment

FIGS. 33 to 36 are views showing other embodiments of the connector.

Figure 33:
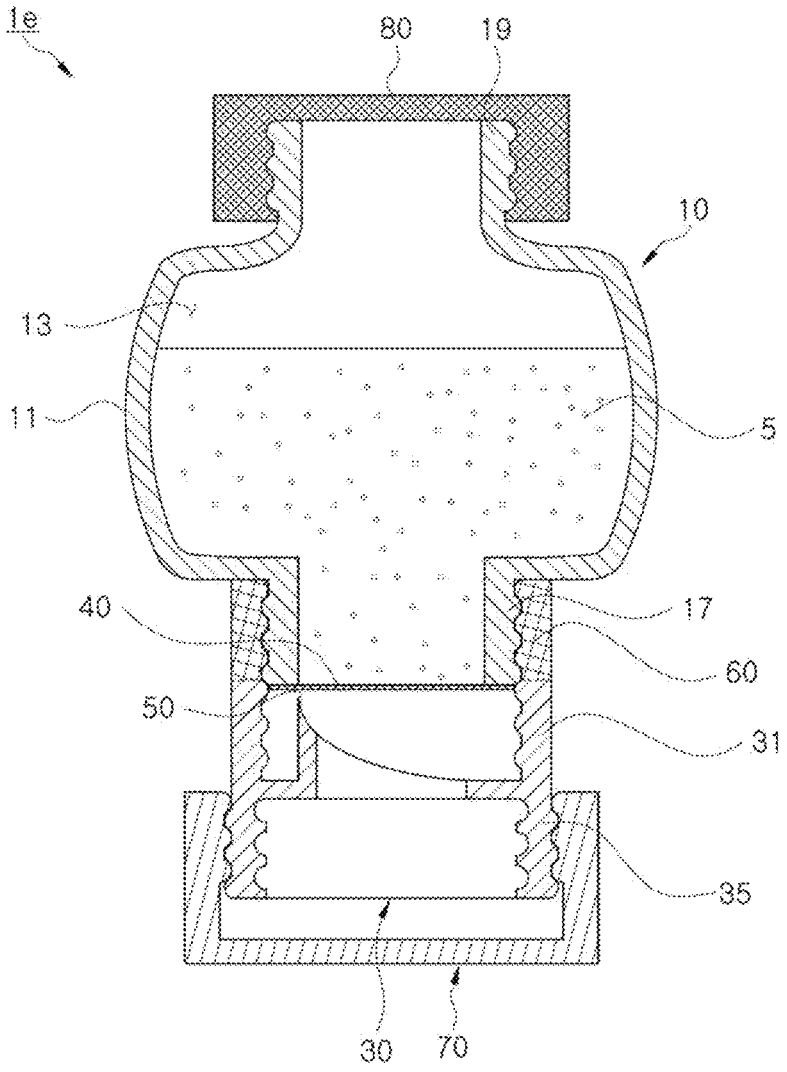
FIGS. 33 to 36 are views showing other embodiments of the connector.

FIG. 33 is an embodiments in which a band-shaped spacer 60 is provided. That is, a band-shaped spacer 60 is provided to be able to be cut from an end facing the mixing container 10. Further, a female thread for engaging with the discharge part 17 of the mixing container 10 is formed on the inner surface of the spacer 60. In this case, the width of the spacer 60 may be larger than or the same as the gap between the cutter 50 and the blocking film 40 to prevent the cutter 50 from cutting the blocking film 40 when the mixing container 10 and the connector 30 are initially assembled.

The blocking film 40 is a sealing sheet membrane thermally bonded to the upper end of the discharge part 17 of the mixing container 10.

The connector cap 70 is separably thread-fastened to the outer surface of the outlet 35 of the connector 30.

Figure 34:
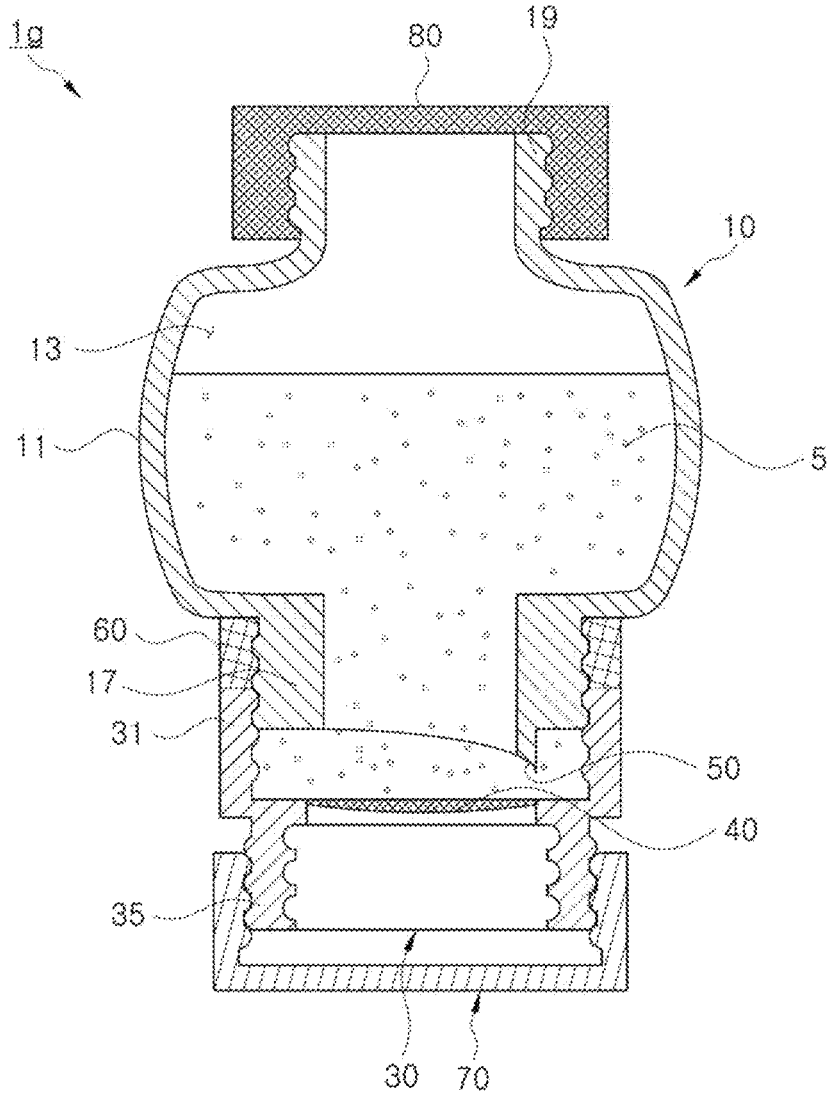

FIG. 34 is a view showing a new embodiment of the blocking film. That is, in a mixing container unit 1*g* according to the present disclosure, a sheet-shaped blocking film 40 gently protruding at the center portion is supported on the inner surface of the passage part 31 of the connector 30.

The cutter 50 spirally protrudes from the front end of the discharge part 17 of the mixing container 10 in consideration of the configuration that the blocking film 40 is provided at the connector 30.

Accordingly, when the mixing container 10 is moved with respect to the connector 30 through thread-rotation, the edge of the blocking film 40 mounted on the inner surface of the passage part 31 of the connector 30 is brought in contact with and cut by the cutter 50 at the front end of the discharge part 17 of the mixing container 10. As the blocking film 40 is cut, the passage part 31 of the connector 30 is opened, and the discharge part 17 of the mixing container 10 and the passage part 31 of the connector 30 communicate with each other, whereby the additive 5 kept in the mixing container 10 flows to the outlet 35 of the connector 30 and is mixed with the drink 110 kept in the drinking container 100.

Figure 35:
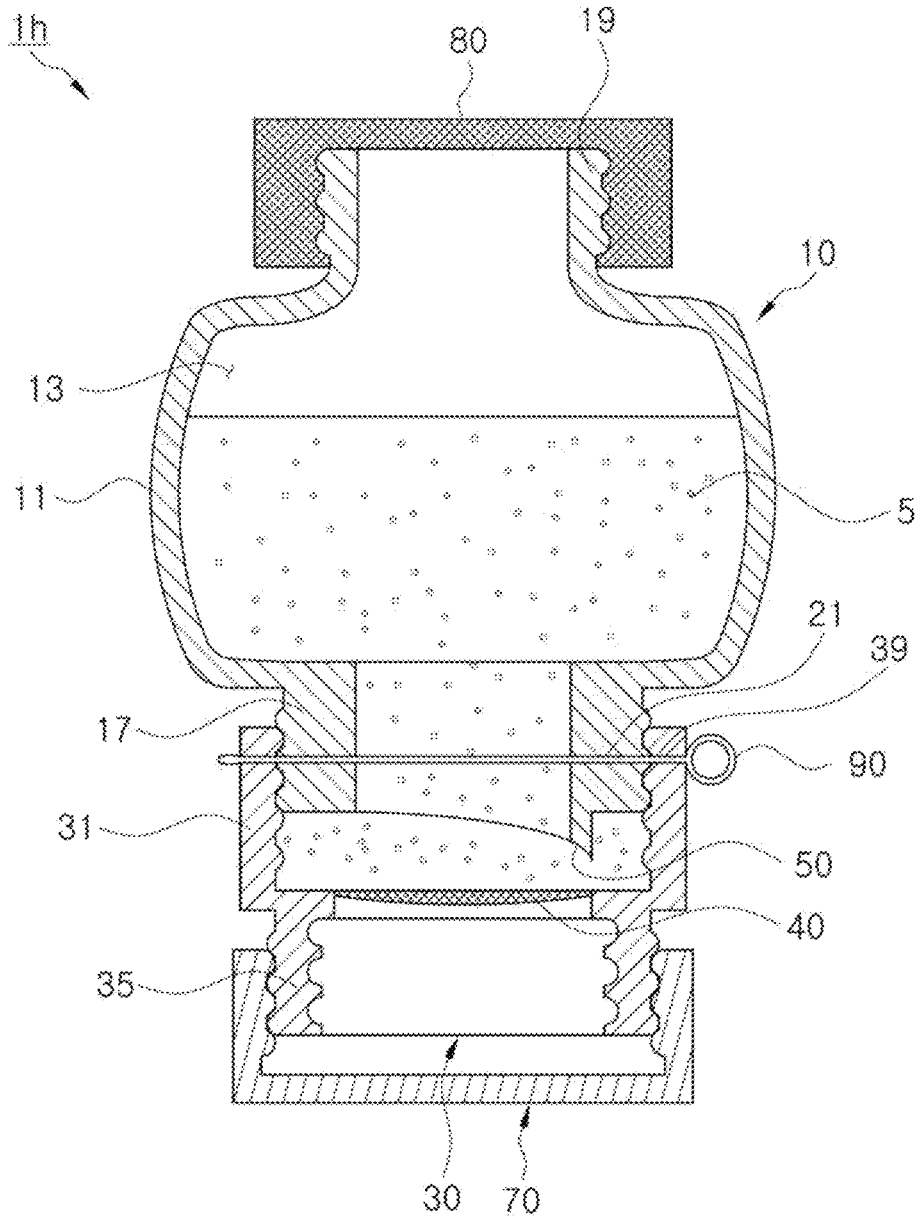

FIG. 35 is a view showing an embodiment in which a connector has a safety pin. That is, a mixing container unit 1*h* according to the present disclosure does not have the spacer and a safety pin 90 is disposed through the mixing container 10 and the connector 30.

The safety pin 90 is inserted in through-holes 21 and 39 formed at the mixing container 10 and the connector 30, respectively, thereby restricting relative movement of the mixing container 10 and the connector 30. In this case, the safety pin 90 may be inserted in the through-holes 21 and 39 of the mixing container 10 and the connector 30, respectively, to prevent the cutter 50 from cutting the blocking film 40 when the mixing container 10 and the connector 30 are initially assembled.

Accordingly, the cutter 50 and the blocking film 40 are spaced apart from each other with the safety pin 90 disposed through the mixing container 10 and the connector 30. When the safety pin 90 is removed from the mixing container 10 and the connector 30 and then the mixing container 10 is thread-rotated with respect to the connector 30, the edge of the blocking film 40 mounted on the inner surface of the passage part 31 of the connector 30 is brought in contact with and cut by the cutter 50 at the front end of the discharge part 17 of the mixing container 10, whereby the additive 5 kept in the mixing container 10 flows to the outlet 35 of the connector 30 and is mixed with the drink 110 kept in the drinking container 100.

Figure 36:
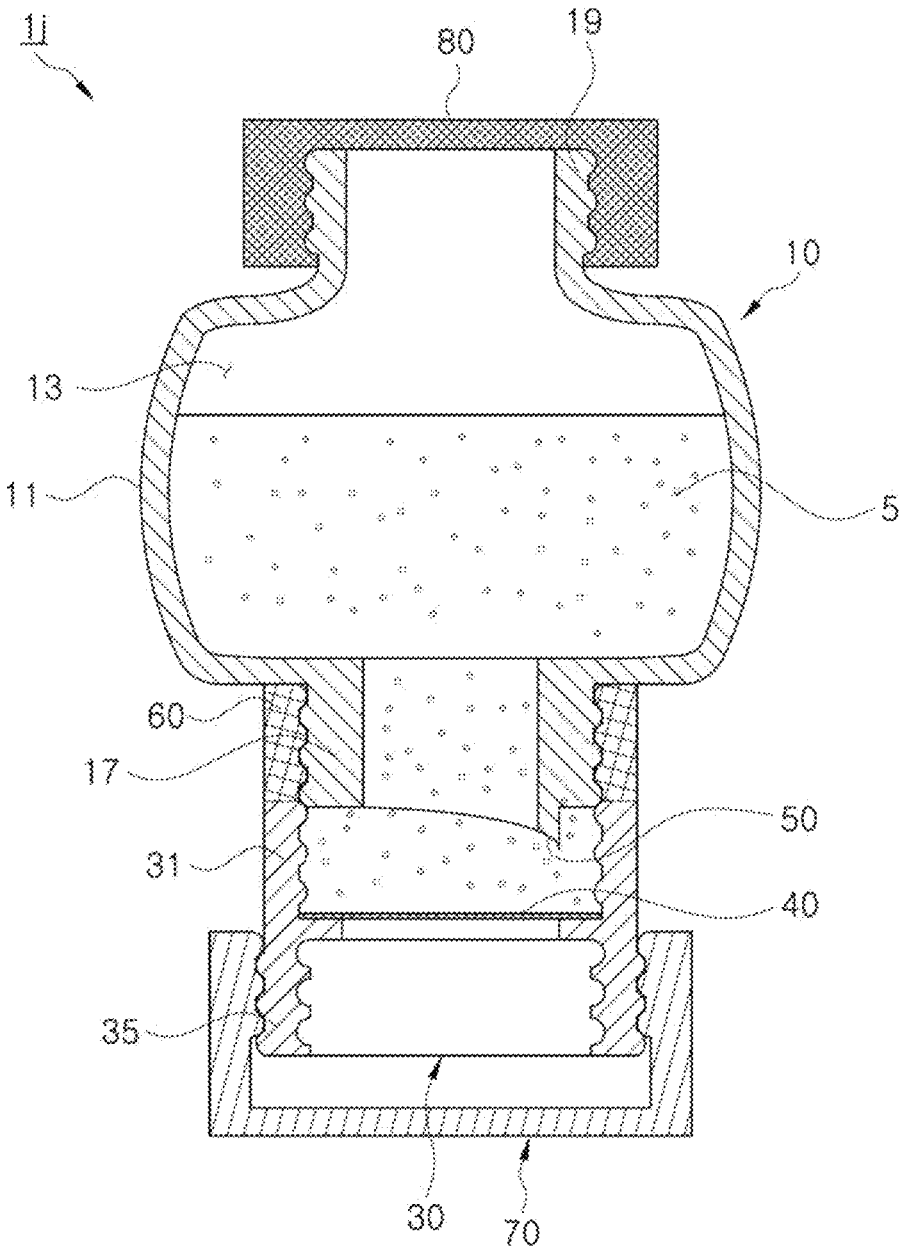

FIG. 36 is a view showing an embodiment in which a thermally bonded sealing sheet membrane is proposed. That is, in a mixing container unit 1*j* according to the present disclosure, the blocking film 40 is a sealing sheet membrane thermally bonded to the inner surface of the passage part 31 of the connector 30.

Meanwhile, in the embodiment of FIG. 33 to 36 or the previous embodiments of the present disclosure, the connector cap 70 may be separably thread-fastened to the outer surface of the container body 11 of the mixing container 10. That is, a thread may be formed on the outer surface of the lower end of the mixing container 10.

Meanwhile, since the mixing container units 1*g*, 1*h*, and 1*i* have the blocking film 40 at the connector 30, it is possible to reuse the mixing container 10 by coupling a new connector 30 to the mixing container 10.

Another Embodiment

Figure 37:
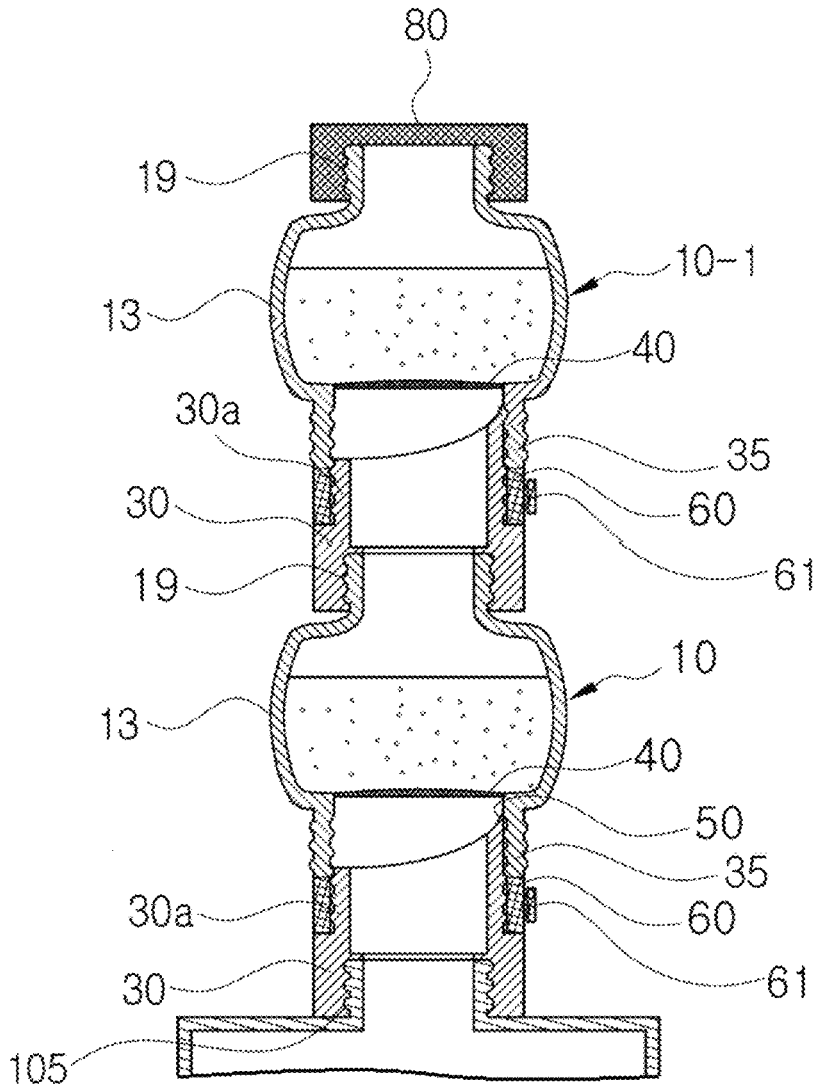
FIG. 37 is a view showing an embodiment in which two chambers are sequentially connected.

FIG. 37 is a view showing an embodiment in which two chambers are sequentially connected.

As shown in the figure, it is possible to couple a mixing container (concentrate container) 10 to the drinking container 100 by connecting the chamber 13 to the drinking container neck 105. Depending on cases, it is possible to couple another mixing container (concentrate container) 10-1 to the top of the mixing container (concentrate container) coupled to the drinking container 100.

To this end, the diameter of the mouth 19 of the concentrate container should be the same as that of the neck 105 of the drinking container, and the shape and size of the thread formed on the outer surface of the mouth 19 of the concentrate container should be the same as the shape and size of the thread formed on the outer surface of the drinking water outlet. That is, the mouth 19 should be formed to be able to be engaged with the inner thread of the connector 30 under the mixing container (concentrate container) 10 or the inner thread of the container outlet 35-1.

Meanwhile, the chamber of the present disclosure may be made of a transparent plastic material and a scale may be marked on the outer surface of the chamber so that a user can see the amount of a concentrate that is put in the chamber. Obviously, the material is not necessarily limited to a transparent plastic material and may be a metallic material.

Another Embodiment

Figure 38:
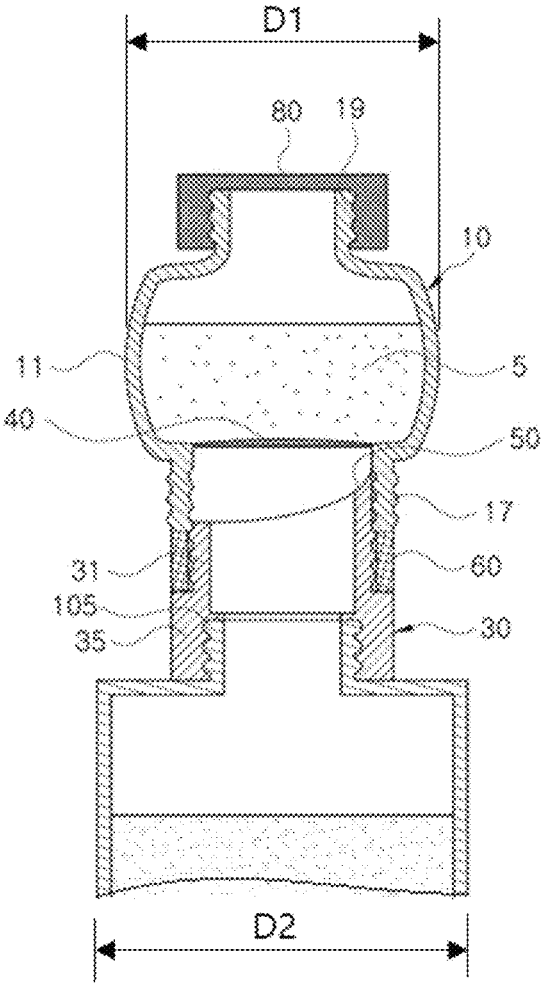
FIGS. 38 and 39 are views showing an embodiment of the size and volume of a mixing container.
Figure 39:
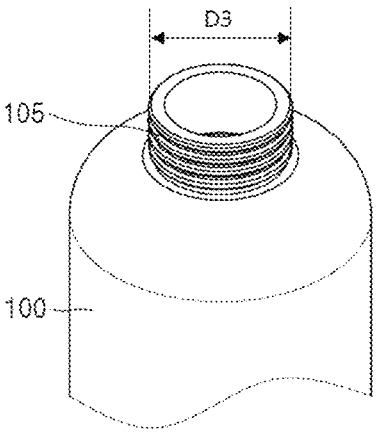

FIGS. 38 and 39 are views showing an embodiment of the size and volume of a mixing container.

FIG. 38 is a view showing an embodiment of the size of the mixing container 10, in which the mixing container 10 is coupled to the upper end of the drinking container 100, so it is required to keep the balance of force stable when they are combined.

Accordingly, the diameter D1 of the mixing container 10 may be smaller than the diameter D2 of the drinking container 100. For example, D1 may be smaller by 10% or more than D2. However, when D1 is too small, the ratio is not appropriate (a design ratio is important for the commercial value of a product), so D1 may be 20% or more of D2.

As another reference for the ratio, D1 may not exceed 6 cm, which is a value determined in consideration of the diameter of 500 ml plastic bottles. Further, D1 may be within 5 cm.

Another reference may be proposed. Referring to FIG. 39, when the diameter of the neck 105 of the drinking container 100 (the portion that is thread-fastened to the outlet 35 of the connector 30) is D3, D1 may be larger than D3. There is a reason for further applying force when rotating it by hand other than the design ratio for the commercial value of a product.

As another reference for the ratio, D1 may be 2.8 cm or more and 4 cm or less.

Figure 40:
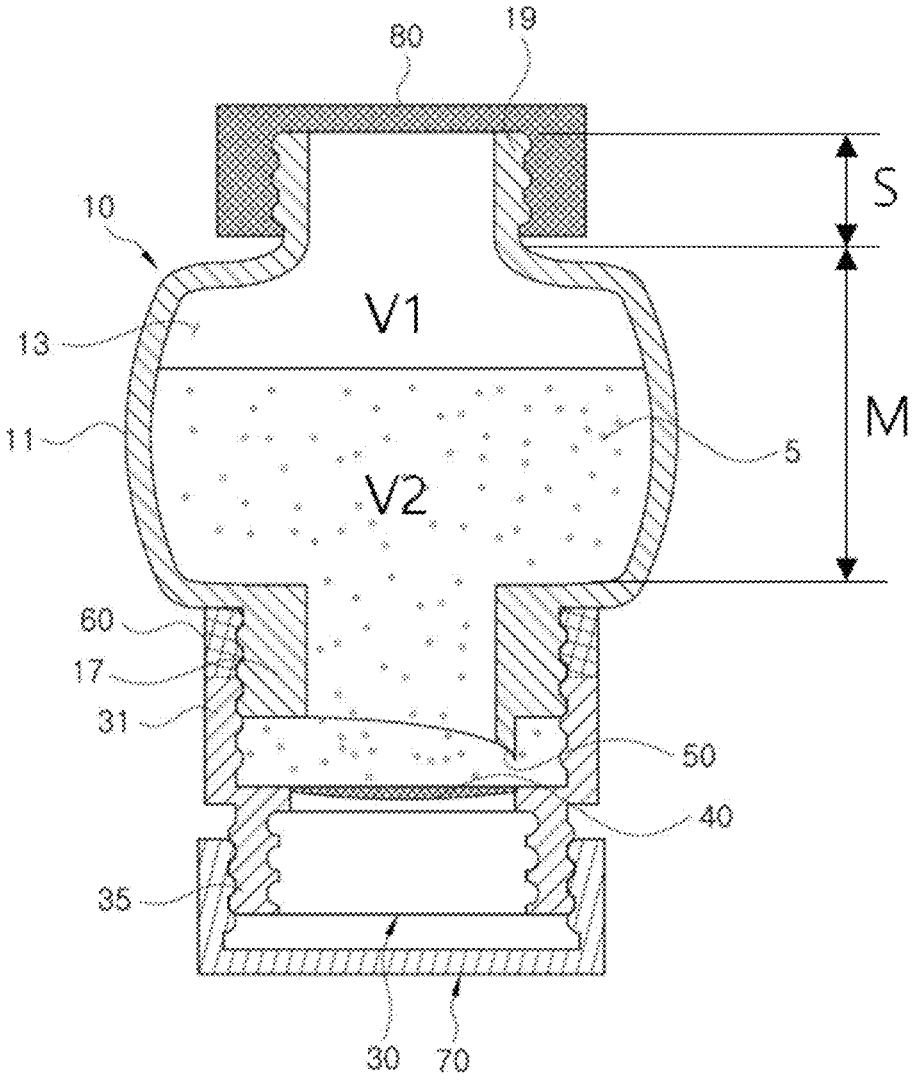
FIG. 40 is a view showing the area where air exists in the mixing container 10.

FIG. 40 is a view of an embodiment showing a region in which air exists in the mixing container 10 and it is not preferable that the mixing container 10 is fully filled with the additive 5.

As shown in FIG. 40, a region filled with air should exist in the region of the chamber 13 (the region M in FIG. 40) except for the region of the assistant passage part 19 (the region Sin FIG. 40) of the mixing container 10.

This is because when air exists in a predetermined region, mixing is easily made when the mixing container 10 is combined with the drinking container 100 and the additive 5 in the mixing container 10 is mixed with the liquid in the drinking container 100.

When the volume of the air in the region M that is the chamber region is V1 and the volume of the additive is V2, at least the following condition may be satisfied.

$$10 \leq V1/(V1+V2) \leq 50$$

That is, the volume of air in the region M in the chamber is 10% to 50%. When air occupies a too small region, mixing does not occur, so the volume of the air may be 10% or more. However, when the region that air occupies is too large, the efficiency of the mixing container 10 is reduced and the commercial value is deteriorated. Accordingly, the region that air occupies may not exceed 50%.

Another Embodiment

FIGS. 41 to 49 are views showing an embodiment in which a cup is used as a drinking container and a concentrate is put into the cup as an additive.

It should be noted that, in the specification, a drink that is put into the cup is a general term that means drinking water, natural water, liquors, etc., and the additive is a general term that means a high-concentration extract, a concentrate having predetermined concentration, etc. Further, not only an extract, but also powder may be included in the additive.

Figure 41:
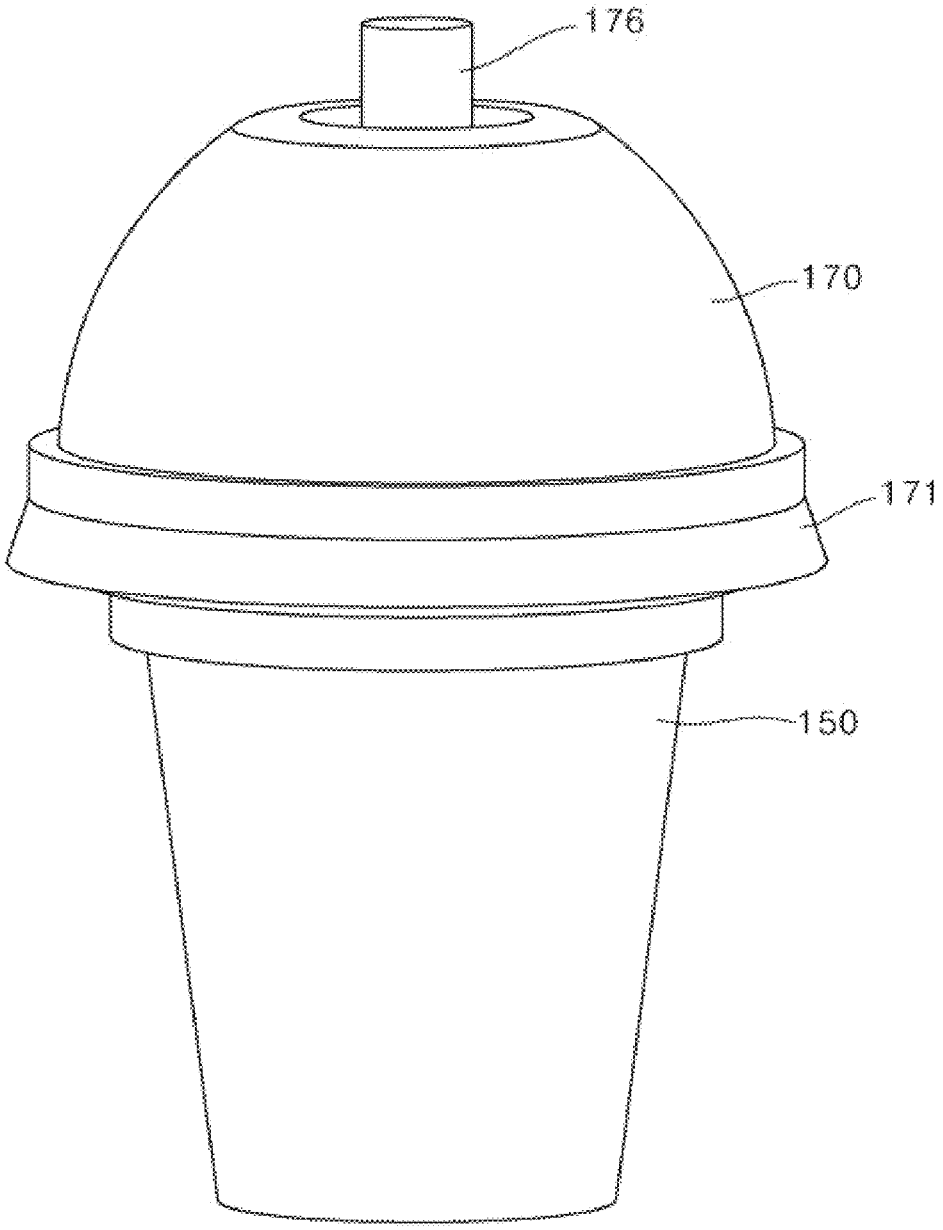
FIGS. 41 to 49 are views showing an embodiment in which a cup is used as a drinking container and a concentrate is put into the cup as an additive.
Figure 42:
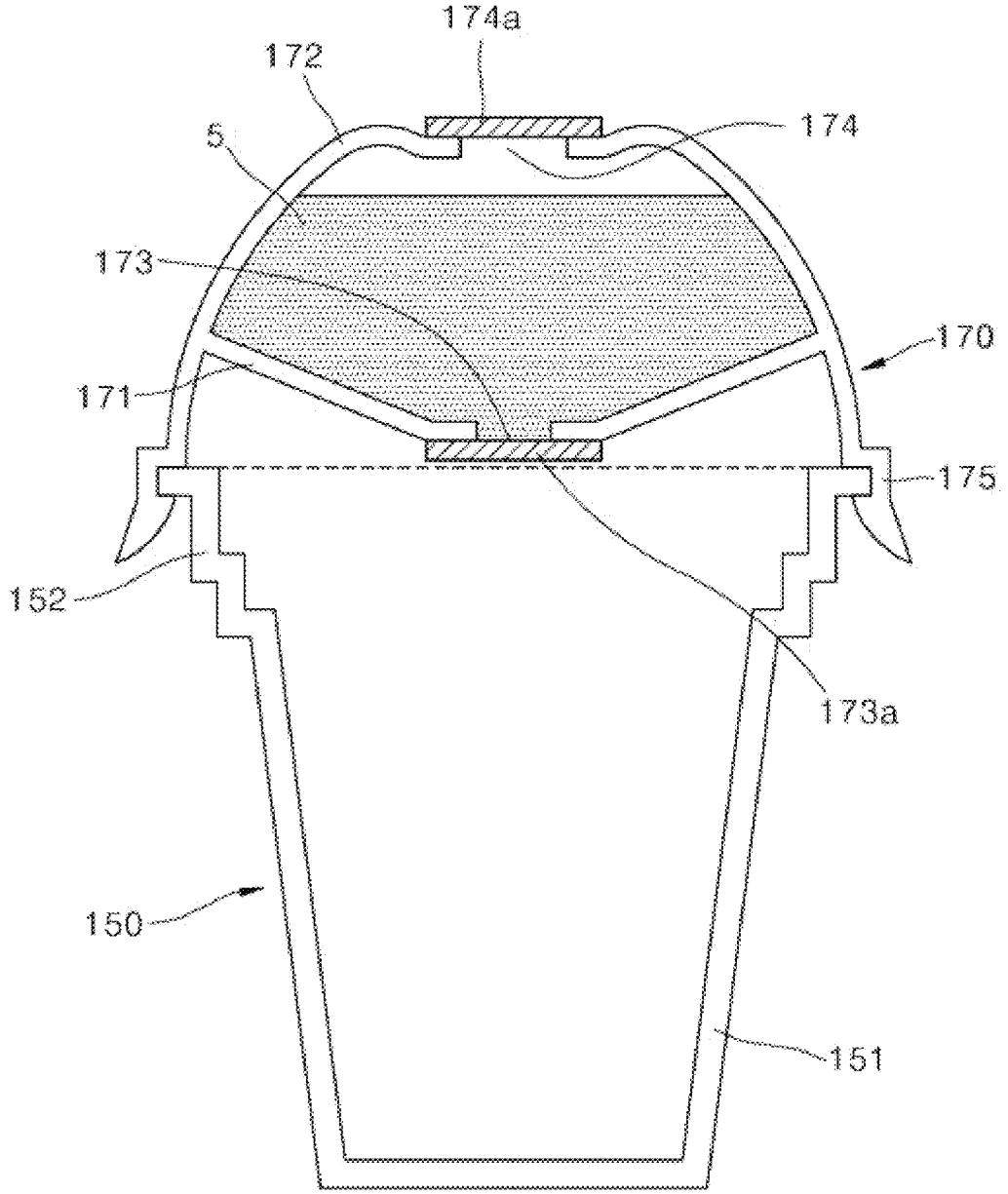

FIG. 41 is a view showing a cup chamber 170 mounted on a cup 150 filled with a drink, in which a concentrate or powder is in the cup chamber 170. FIG. 42 is a view of an embodiment showing the internal structures of the cup 150 filled with a drink and the cup chamber 170.

As shown in FIG. 42, a drink is kept in the cup 150 having a cup side 151 and a cup fastening portion 152 (In the embodiment of FIG. 42, a drink is not shown, but it is assumed that a drink is kept in the cup 150). The cup chamber 170 also has a chamber fastening portion 175, and the cup fastening portion 152 and the chamber fastening portion 175 are coupled to each other by groove-protrusion fitting.

The cup chamber 170 has a chamber-outer portion 172 and a chamber bottom 172, and a concentrate or powder 5 is kept in the space defined by the chamber-outer portion 172 and the chamber bottom 172.

The chamber bottom 171 is inclined and an inlet 173 is disposed under the inclined chamber bottom 171, so a concentrate or powder is put into the cup 150 through the inlet 173. A chamber bottom cover 173*a* is provided to close the inlet 173.

Thermal bonding or a common method that uses an adhesive is used as the method of attaching the chamber bottom cover 173*a* to the outer flat surface of the chamber bottom 171. When an adhesive is used, the chamber bottom cover 173*a* may be bonded such that a user can take it off.

An outlet 174 is formed at the flat portion of the top of the chamber-outer portion 172, so a drink mixed with a concentrate or powder is discharged through the outlet 174. A chamber top cover 174*a* closing the outlet 174 is further provided, thereby sealing the outlet 174. The chamber top cover 174*a* is attached to the outer surface of the flat portion at the top of the chamber-outer portion 172.

Thermal bonding or a common method that uses an adhesive is used as a method of attaching the chamber top cover 174*a*. Meanwhile, when an adhesive is used, the chamber top cover 174*a* may be bonded such that a user can take it off.

It may be possible to consider a method of discharging a drink mixed with a concentrate or powder in the view-point of a user.

The chamber top cover 174*a* can be taken off and separated. It may be possible to pass a straw through the outlet 174 such the lower portion of the straw breaks the chamber bottom cover 173*a* and the straw reaches the inside of the cup 150. To this end, the chamber bottom cover 173*a* is formed as a thin film to be able to be broken. That is, the chamber bottom cover 173 may be the cover (made of a film) of common yogurt bottles that a straw can pass through.

In order to take off and separate the chamber top cover 174*a*, a film-type grip may be attached to the chamber top cover 174*a*. In this case, a film-type grip for taking off the cover (made of a film) of common yogurt bottles may be used.

Figure 43:
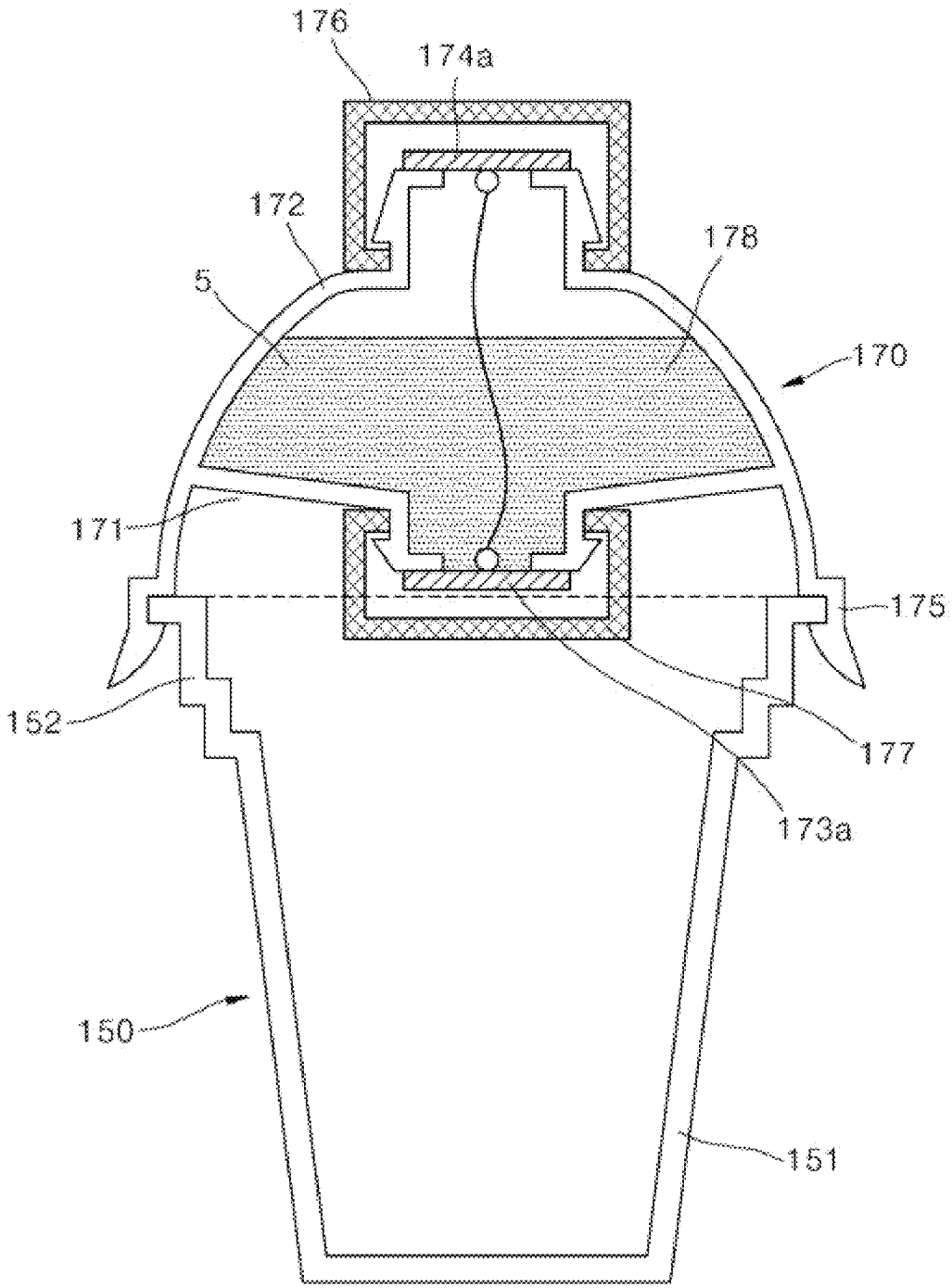
Figure 44:
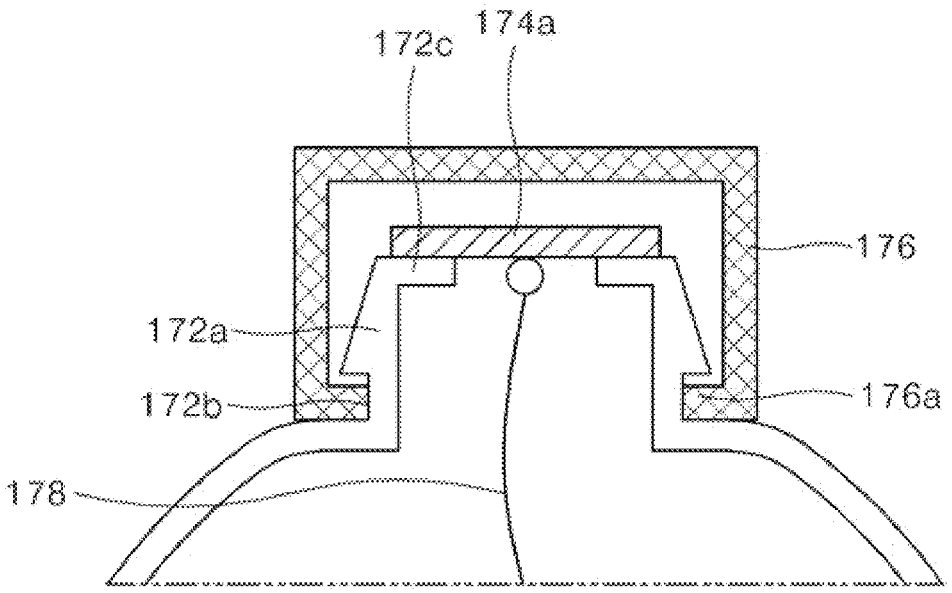
Figure 44:
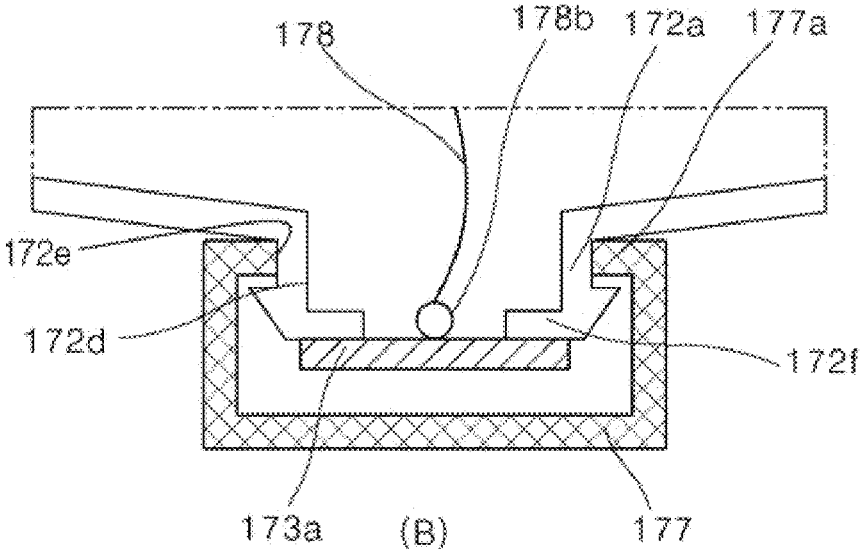

FIGS. 43 and 44 are views of an embodiment in which a chamber top cap 176 and a chamber bottom cap 177 are provided. That is, protrusions 172*a* and 172*d* are formed around the inlet 173 and the outlet 174, respectively, and the chamber top cap 176 and the chamber bottom cap 177 are coupled to the protrusions 172*a* and 172*d*, respectively.

To this end, as in FIG. 44, an upper protrusion groove 172*b* is formed at the upper protrusion 172*a*, whereas an upper cap protrusion 176*a* is formed at the chamber top cap 176. Accordingly, the upper cap protrusion 176*a* may be inserted in the upper protrusion groove 172*b* so that the chamber top cap 176 is coupled to the upper protrusion 172*a*. To this end, the chamber top cap 176 has to have elasticity. The protrusion 172*a* and the upper cap 176 may be coupled by thread-fastening rather than groove-protrusion fitting, and a common method may be used for the thread-fastening.

Similarly, a lower protrusion groove 172*e* is formed at the lower protrusion 172*d*, whereas a lower cap protrusion 177*a* is formed at the chamber lower cap 177. Accordingly, the chamber bottom cap 177 may be coupled to the lower protrusion 172*d* by inserting the lower can protrusion 177*a* in the lower protrusion groove 712*e*. To this end, the chamber bottom cap 177 has to have elasticity. The protrusion 172*d* and the lower cap 177 may be coupled by thread-fastening rather than groove-protrusion fitting, and a common method may be used for the thread-fastening.

An upper protrusion extension 172*c* may be formed at the upper protrusion 172*a*, so the chamber top cover 174*a* is attached to the protrusion extension 172*c*. A lower protrusion extension 172*f* is formed at the lower protrusion 172*d*, so the chamber bottom cover 173*a* is attached to the protrusion extension 172*f*.

The chamber bottom cover 173*a* and the chamber top cover 174*a* are connected to each other by a connection string 178, so when the chamber top cover 174*a* is pulled up (a film-type grip is used, so the chamber top cover 174*a* can be pulled up when the grip is taken off), the connection string 178 is pulled and the entire or a portion of the chamber bottom cover 173*a* is separated from the protrusion extension 172*f*. In this case, for partial separation, the portion to which the connection string 128 is connected is made to be easily torn.

The connection string 178 may be connected to the chamber top cover 174*a* and the chamber bottom cover 173*a* through string connection portions 178*a* and 178*b*. The string connection portion 178*a* and 178*b* is formed by a common method of attaching a string to a film.

In this case, the embodiment of FIGS. 22 to 24 of the present disclosure may be applied so that the chamber bottom cover is opened. That is, the principle of opening the inlet proposed in the embodiment of FIGS. 22 to 24 may be applied to the cup chamber.

Figure 45:
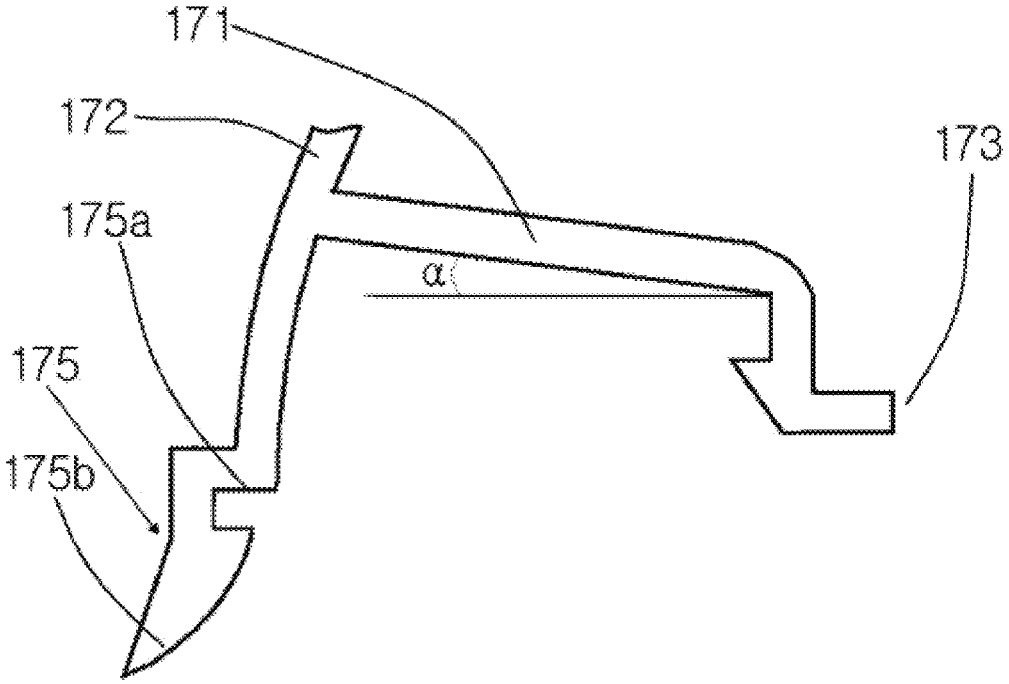

FIG. 45 is a view showing an embodiment of an inclination angle of the chamber bottom 171. A concentrate or powder is kept in the space defined by the chamber bottom 171 and the chamber-outer portion 172 of the cup chamber 170. When the inlet 173 is opened, the concentrate or powder kept in the cup chamber 170 freely drops into the cup chamber 170, whereby the cup 150 is filled with the concentrate or powder. Accordingly, the chamber bottom 172 is inclined so that a concentrate or powder is put into the cup through the inlet 173 formed at the chamber bottom 171.

Accordingly, the inclination angle $\alpha$ of the chamber bottom 171 is meaningful. That is, when the inclination angle $\alpha$ is smaller than 5 degrees, a concentrate or powder may not freely drop well. When the inclination angle $\alpha$ is too large, the space defined by the chamber bottom 171 and the chamber-outer portion 172 is too small, so efficiency of the cup chamber 170 is deteriorated. Accordingly, it is appropriate that the inclination angle $\alpha$ has the following range.

$$5 \text{ degrees } (^\circ) \leq \text{inclination angle } \alpha \text{ of chamber bottom } \mathbf{171} \leq 70 \text{ degrees } (^\circ).$$

Further, when a fastening blade 175*b* is formed at the end of the chamber fastening portion 175, the end of the fastening blade 175*b* is formed to face the outside. Accordingly, when the cup chamber 170 is separated from the cup 150, it is easily separated by the fastening blade 175*b*.

FIGS. 46 to 49 are views showing embodiments of ways that the cup chamber 170 is substantially sold.

Figure 46:
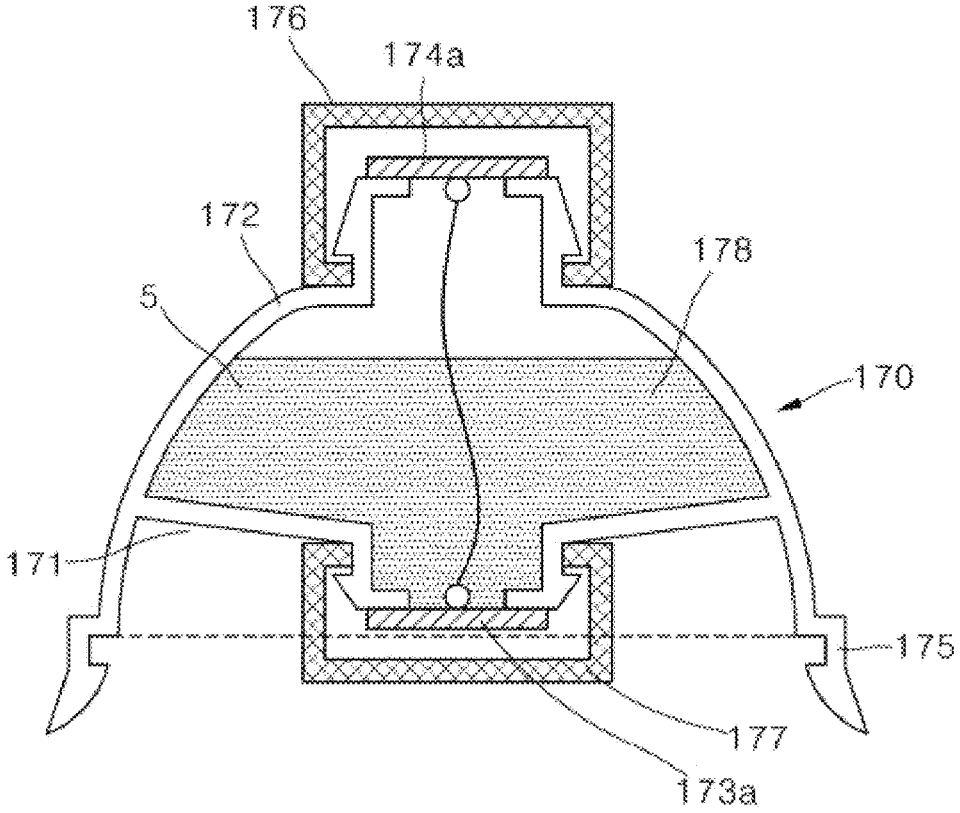
Figure 47:
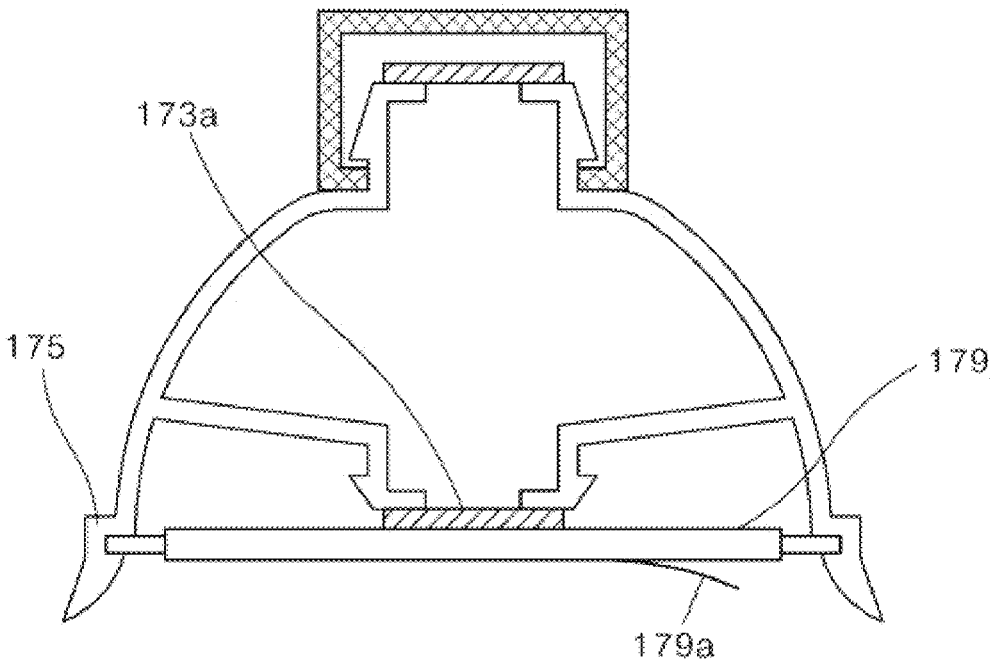
Figure 48:
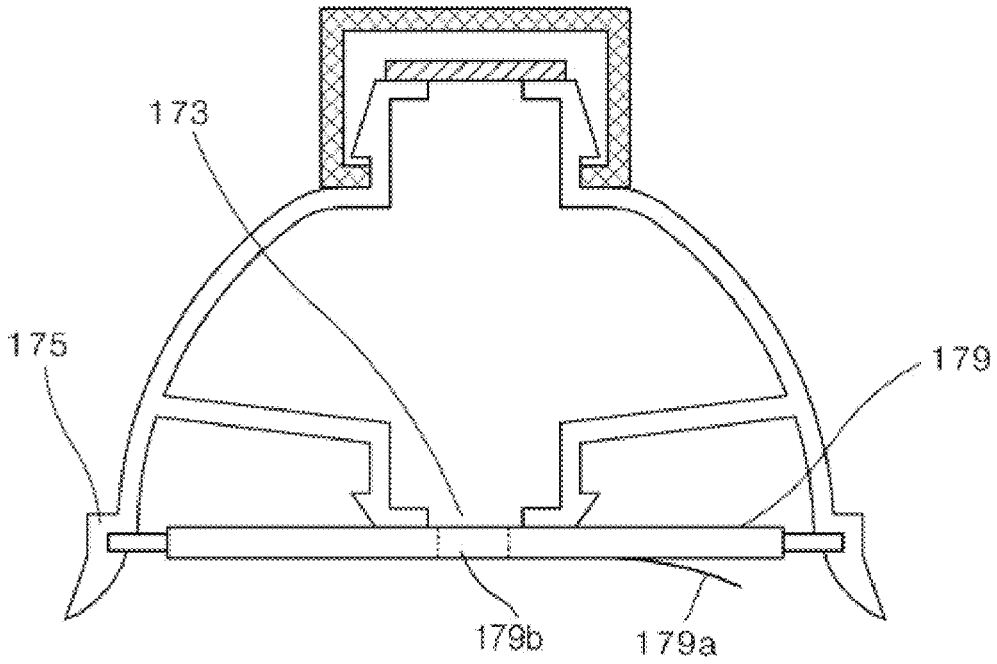
Figure 49:
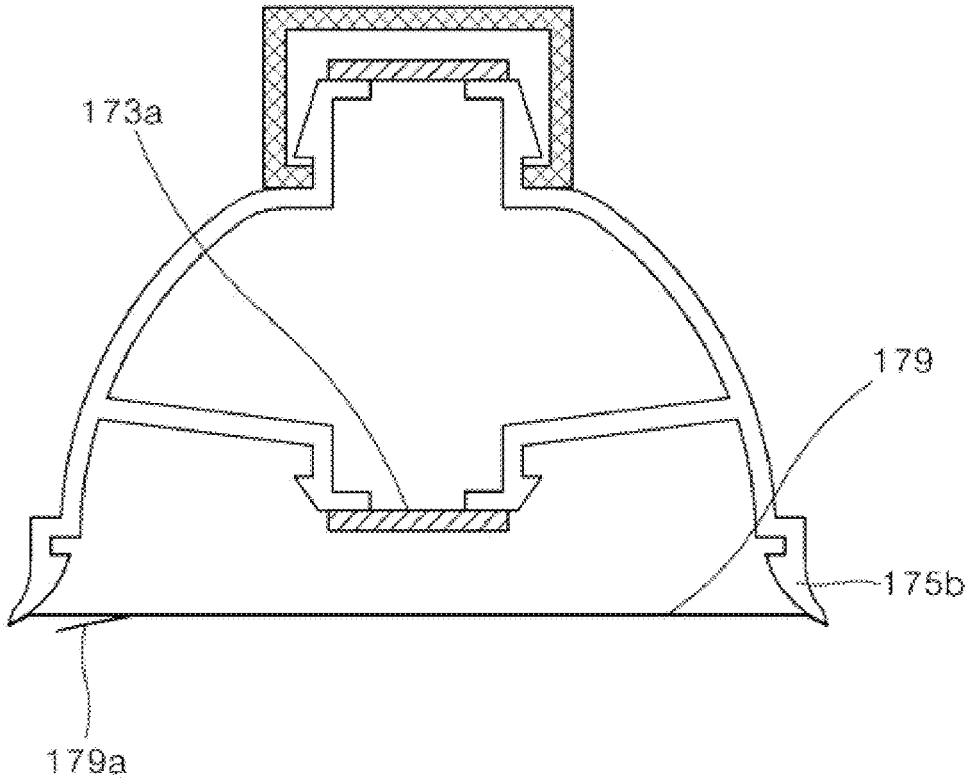

FIG. 46 is a view of an embodiment in which the chamber top cap 176 and the chamber bottom cap 177 are provided. FIGS. 47 to 49 are views of an embodiment in which a sealing plate 179 is provided. The sealing plate 179 is inserted and fixed in the fastening groove 175*a*. A plate handle 179*a* is provided at the sealing plate 179, so it is possible to separate the sealing plate 179 by pulling the plates handle 179 by hand.

The sealing plate 179 is coupled to the fastening groove 175*a*. To this end, the sealing plate 179 may be made of coating paper or plastic that has a thickness of about 1 mm to 5 mm.

Meanwhile, FIG. 47 is a view of an embodiment in which both the chamber bottom cover 173*a* and the sealing plate 179 are provided, and FIG. 48 is a view of an embodiment in which the chamber bottom cover 173 functions as the sealing plate 179, so only the chamber bottom cover 173*a* is provided.

Further, the region corresponding to the inlet 173 may be separated from the entire sealing plate 179. Accordingly, since only the region corresponding to the inlet 173 (the portion indicated by a dotted line at the position of the inlet 173 in the sealing plate 179 in FIG. 48) is separated from the entire sealing plate 179, whereby the inlet 173 is opened so that a concentrate or powder can be put in.

That is, a sealing plate cutting-portion 179*b* is provided, so when the connection string 178 (see the embodiment of FIG. 44) is pulled, the sealing plate cutting-portion 179*b* is easily cut and separated from the sealing plate 179, so the inlet 173 is opened.

In this case, the lower cover 179*a* may be made of film, paper, resin, etc. and may have an area such that it can be pulled by hand through the connection string 178.

FIG. 49 is a view of an embodiment in which the sealing plate 179 is attached to the fastening blade 175*b*. In this case, the sealing plate 179 is provided as a thin film type. The sealing plate 179 can be separated from the fastening blade 175*b* when a user holds and pulls the plate handle 179*a*.

Meanwhile, the chamber of the present disclosure may be made of a transparent plastic material and a scale may be marked on the outer surface of the chamber so that a user can see the amount of a concentrate that is put in the chamber. Obviously, the material is not necessarily limited to a transparent plastic material and may be a metallic material.

What is claimed is:

1. A mixing container unit configured to keep an additive therein and arranged to be thread-fastened to a drinking container filled with a liquid-state drink so that the additive can be mixed and drunk with the drink, the mixing container unit comprising:

a mixing container having an assistant passage part that has a predetermined diameter and has a thread on an outer surface thereof, a chamber that communicates with the assistant passage part and keeps the additive therein, a discharge part that communicates with the chamber to discharge the additive and has a thread, and a blocking film that is provided at the discharge part and prevents the additive from moving down;

a connector having a passage part that has a thread on an outer surface thereof and is thread-fastened to the thread formed on the inner surface of the discharge part, an outlet that communicates with the passage part and has a thread on an inner surface thereof, and a cutter that cuts the blocking film by moving with respect to the mixing container, and configured to be separably thread-fastened to the mixing container; and a mixing container cap thread-fastened to the thread on the outer surface of the assistant passage part and configured to open and close the assistant passage part, wherein coupling to the drinking container is made by thread-fastening of the thread formed on the inner surface of the outlet and a thread formed at a drinking container neck, wherein the thread formed on the inner surface of the outlet and the thread formed on the outer surface of the assistant passage part are formed in predetermined sizes to be engaged with each other.

2. The mixing container unit of claim 1, further comprising a spacer separably provided at the mixing container or the connector and maintaining a gap between the mixing container and the connector to prevent the cutter from cutting the blocking film, wherein the spacer is thread-fastened to the mixing container or the connector.

3. The mixing container unit of claim 1, further comprising a connector cap separably provided at the mixing container or the connector, and keeping and protecting the connector therein.

4. The mixing container unit of claim 1, wherein the cutter spirally protrudes from a front end of the passage part.

* * * * *